US011988059B2

(12) United States Patent
McKenzie

(10) Patent No.: US 11,988,059 B2
(45) Date of Patent: May 21, 2024

(54) DUAL ACTIVITY TOP DRIVE

(71) Applicant: NATIONAL OILWELL VARCO, L.P., Houston, TX (US)

(72) Inventor: Andrew Ian McKenzie, Cypress, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 175 days.

(21) Appl. No.: 17/310,672

(22) PCT Filed: Feb. 20, 2020

(86) PCT No.: PCT/US2020/019039

§ 371 (c)(1),
(2) Date: Aug. 17, 2021

(87) PCT Pub. No.: WO2020/172407

PCT Pub. Date: Aug. 27, 2020

(65) Prior Publication Data

US 2022/0145704 A1 May 12, 2022

Related U.S. Application Data

(60) Provisional application No. 62/809,093, filed on Feb. 22, 2019.

(51) Int. Cl.
*E21B 3/02* (2006.01)
*E21B 19/16* (2006.01)

(52) U.S. Cl.
CPC ..... *E21B 3/022* (2020.05); *E21B 19/16* (2013.01)

(58) Field of Classification Search
CPC ..... E21B 3/022; E21B 19/16
See application file for complete search history.

(56) References Cited

U.S. PATENT DOCUMENTS

| | | | |
|---|---|---|---|
| 600,988 | A | 3/1898 | Hayes |
| 1,386,210 | A | 8/1921 | Thomas |
| 1,494,524 | A | 5/1924 | Adamson |

(Continued)

FOREIGN PATENT DOCUMENTS

| | | | |
|---|---|---|---|
| CA | 2911388 | A1 | 11/2014 |
| CA | 2855105 | A1 | 12/2015 |

(Continued)

OTHER PUBLICATIONS

"U.S. Appl. No. 16/431,533, Final Office Action dated Jul. 21, 2022", 13 pgs.

(Continued)

*Primary Examiner* — Christopher J Sebesta
(74) *Attorney, Agent, or Firm* — Schwegman Lundberg & Woessner, P.A.

(57) ABSTRACT

A dual activity top drive may include a mechanized system configured for suspension from a traveling block of a drill rig and for engaging and rotating a drill string from the top of the drill string. The dual activity top drive may also include a primary pipe handling system suspended from the mechanized system and configured for handling a pipe string and an auxiliary pipe handling system suspended from the mechanized system and configured for handling a segment of pipe to be added or removed from the pipe string.

14 Claims, 19 Drawing Sheets

(56) References Cited

U.S. PATENT DOCUMENTS 1,589,781 A 6/1926 Anderson
1,818,278 A 8/1931 Siler
2,109,344 A 2/1938 Selger
2,314,867 A 3/1943 Alexander
2,531,930 A 11/1950 Woolslayer et al.
2,613,051 A 10/1952 Joseph
2,615,681 A 10/1952 True
2,616,646 A 11/1952 Frederick
2,735,556 A 2/1956 Stone
2,885,096 A 5/1959 De
2,946,464 A * 7/1960 Guier ..... E21B 19/14 414/22.68
3,154,275 A 10/1964 Stewart
3,225,949 A 12/1965 Erickson et al.
3,272,365 A 9/1966 Stevens
3,361,453 A 1/1968 Brown et al.
3,533,516 A 10/1970 Guier
3,615,027 A 10/1971 Ham
3,623,753 A 11/1971 Henry
3,651,845 A 3/1972 Propst
3,747,789 A 7/1973 Shipley et al.
3,768,663 A 10/1973 Turner et al.
3,840,128 A 10/1974 Swoboda et al.
3,877,583 A 4/1975 Bokenkamp
3,921,823 A 11/1975 Bourree et al.
3,976,207 A 8/1976 Schultz
3,994,350 A 11/1976 Smith et al.
4,039,744 A 8/1977 Seaquist
4,042,123 A 8/1977 Sheldon et al.
4,117,941 A 10/1978 Mccleskey, Jr. et al.
4,126,348 A 11/1978 Palmer
4,269,554 A 5/1981 Jackson
4,274,778 A 6/1981 Putnam et al.
4,289,442 A 9/1981 Stevens
4,345,864 A 8/1982 Smith, Jr. et al.
4,348,920 A 9/1982 Boyadjieff
4,397,605 A 8/1983 Cowgill et al.
4,531,875 A 7/1985 Krueger
4,591,006 A 5/1986 Hutchison et al.
4,621,974 A 11/1986 Krueger
4,680,519 A 7/1987 Chand et al.
4,715,761 A 12/1987 Berry et al.
4,738,321 A 4/1988 Olivier
4,846,357 A 7/1989 Sholl et al.
4,861,081 A 8/1989 Satoh
4,899,095 A 2/1990 Kishi et al.
5,038,871 A 8/1991 Dinsdale
5,211,251 A 5/1993 Woolslayer
5,494,320 A 2/1996 Cerruti
5,813,286 A 9/1998 Hansen
5,921,329 A 7/1999 Armstrong
6,047,771 A 4/2000 Roeynestad
6,260,646 B1 7/2001 Fernandez et al.
6,412,576 B1 7/2002 Meiners
6,460,900 B1 10/2002 Bakke
7,137,616 B2 11/2006 Kysely
7,219,744 B2 * 5/2007 Pietras ..... E21B 19/06 166/77.51
7,249,639 B2 7/2007 Belik
7,341,281 B2 3/2008 Guesnon et al.
7,370,707 B2 5/2008 Mcdaniel et al.
7,390,032 B2 6/2008 Hughes
7,493,960 B2 2/2009 Leising et al.
7,726,929 B1 6/2010 Orgeron
7,905,311 B2 3/2011 Brown
7,946,795 B2 5/2011 Orgeron
7,984,757 B1 7/2011 Keast et al.
8,074,484 B2 12/2011 Denkmeier et al.
8,191,637 B2 6/2012 Havinga
8,210,269 B2 7/2012 Hudson et al.
8,317,448 B2 11/2012 Hankins et al.
8,504,206 B2 8/2013 Fudaba et al.
8,550,761 B2 10/2013 Belik et al.
8,690,508 B1 4/2014 Orgeron
8,936,424 B1 1/2015 Barnes et al.
9,133,968 B2 9/2015 Elrick et al.
9,157,286 B2 10/2015 Richardson et al.
9,291,010 B1 3/2016 Barnes
9,388,923 B2 7/2016 Romano
9,706,185 B2 * 7/2017 Ellis ..... H04N 13/204
9,845,645 B2 12/2017 Hughes et al.
10,047,908 B1 8/2018 Bohle, II et al.
10,053,934 B2 8/2018 Keogh et al.
10,190,374 B2 1/2019 Bowley et al.
10,246,952 B2 4/2019 Trydal et al.
10,384,907 B2 8/2019 Upmeier et al.
10,612,322 B2 4/2020 Doyon
10,794,126 B2 10/2020 Magnuson
10,988,994 B2 4/2021 Clarke et al.
10,995,564 B2 5/2021 Miller et al.
11,035,183 B2 6/2021 Donnally et al.
11,220,888 B2 1/2022 Ocegueda-Hernandez et al.
11,274,508 B2 3/2022 Mckenzie et al.
11,352,843 B2 6/2022 Callaghan
11,365,592 B1 6/2022 Moon et al.
11,613,932 B2 3/2023 Saebo et al.
11,613,940 B2 3/2023 Mckenzie et al.
11,834,914 B2 12/2023 Mckenzie et al.
2002/0175519 A1 11/2002 Mack et al.
2003/0159854 A1 8/2003 Simpson et al.
2004/0057815 A1 3/2004 Woolslayer et al.
2005/0055132 A1 3/2005 Matsumoto et al.
2005/0113971 A1 5/2005 Zhang et al.
2005/0126792 A1 6/2005 Berry
2006/0081379 A1 4/2006 Fehres et al.
2006/0104747 A1 5/2006 Zahn et al.
2006/0124316 A1 6/2006 Pietras
2006/0231344 A1 10/2006 Drzewiecki
2006/0249292 A1 * 11/2006 Guidry ..... E21B 19/06 166/380
2007/0062705 A1 3/2007 Schats et al.
2007/0114069 A1 5/2007 Hooper et al.
2007/0228671 A1 10/2007 Norton
2008/0136203 A1 6/2008 Krijnen et al.
2008/0202812 A1 8/2008 Childers et al.
2008/0238095 A1 10/2008 Yater et al.
2008/0296065 A1 12/2008 Standal
2009/0283324 A1 11/2009 Konduc et al.
2010/0163247 A1 7/2010 Wright et al.
2010/0193198 A1 8/2010 Murray et al.
2010/0303586 A1 12/2010 Hankins et al.
2011/0079434 A1 4/2011 Belik et al.
2011/0120730 A1 5/2011 Clasen et al.
2011/0147009 A1 6/2011 Dupal et al.
2011/0226485 A1 9/2011 Seneviratne et al.
2012/0000671 A1 1/2012 Krohn et al.
2012/0018222 A1 1/2012 Hankins et al.
2012/0259337 A1 10/2012 Del Rio et al.
2013/0075114 A1 3/2013 Dekker et al.
2013/0142607 A1 6/2013 Ditzler
2013/0146305 A1 6/2013 Dupal et al.
2013/0192817 A1 8/2013 Fournier, Jr. et al.
2013/0206478 A1 8/2013 Selzer et al.
2014/0050522 A1 2/2014 Slaughter, Jr. et al.
2014/0054089 A1 2/2014 Sondervik
2014/0090856 A1 * 4/2014 Pratt ..... E21B 19/06 166/380
2014/0097027 A1 4/2014 Marica et al.
2014/0133939 A1 5/2014 Richardson et al.
2014/0145408 A1 5/2014 Midas et al.
2014/0202769 A1 7/2014 Magnuson
2014/0352978 A1 12/2014 Eilertsen et al.
2015/0016925 A1 1/2015 Larkin
2015/0053424 A1 2/2015 Wiens et al.
2015/0127152 A1 5/2015 Nammoto et al.
2015/0148952 A1 5/2015 Shiratsuchi
2015/0232272 A1 8/2015 Magnuson
2015/0272579 A1 10/2015 Leimbach et al.
2015/0273688 A1 10/2015 Harada et al.
2015/0275596 A1 10/2015 Hickie
2015/0283704 A1 10/2015 Watanabe
2015/0330162 A1 11/2015 Magnuson et al.
2016/0024852 A1 1/2016 Kannegaard et al.
2016/0060979 A1 3/2016 Magnuson

(56) References Cited

U.S. PATENT DOCUMENTS

| | | | | |
|---|---|---|---|---|
| 2016/0090786 | A1* | 3/2016 | Roodenburg | E21B 3/02 175/57 |
| 2016/0102508 | A1 | 4/2016 | Fox et al. | |
| 2016/0115745 | A1 | 4/2016 | Bisel | |
| 2016/0145954 | A1 | 5/2016 | Helms et al. | |
| 2016/0160586 | A1 | 6/2016 | Keogh et al. | |
| 2016/0168929 | A1 | 6/2016 | Magnuson et al. | |
| 2016/0201408 | A1 | 7/2016 | Little et al. | |
| 2017/0067303 | A1* | 3/2017 | Thiemann | E21B 33/05 |
| 2017/0172295 | A1 | 6/2017 | Tropper | |
| 2017/0204687 | A1 | 7/2017 | Yorga et al. | |
| 2017/0232620 | A1 | 8/2017 | Kalb et al. | |
| 2017/0234088 | A1 | 8/2017 | Orr et al. | |
| 2017/0268302 | A1 | 9/2017 | Orr et al. | |
| 2018/0002987 | A1 | 1/2018 | Kannegaard et al. | |
| 2018/0171724 | A1 | 6/2018 | Daigle et al. | |
| 2018/0216405 | A1 | 8/2018 | De Mul et al. | |
| 2018/0238120 | A1 | 8/2018 | Patterson et al. | |
| 2018/0245408 | A1 | 8/2018 | Keogh et al. | |
| 2018/0328112 | A1 | 11/2018 | Berry et al. | |
| 2018/0334865 | A1 | 11/2018 | Miller et al. | |
| 2019/0017334 | A1 | 1/2019 | Loeyning et al. | |
| 2019/0063168 | A1 | 2/2019 | Reddy et al. | |
| 2019/0063649 | A1 | 2/2019 | Snyder, II | |
| 2019/0143532 | A1 | 5/2019 | Cutkosky et al. | |
| 2019/0145197 | A1 | 5/2019 | Callaghan | |
| 2019/0309585 | A1 | 10/2019 | Miller et al. | |
| 2019/0352982 | A1 | 11/2019 | Arefi et al. | |
| 2020/0032597 | A1 | 1/2020 | Jorgic et al. | |
| 2020/0040673 | A1 | 2/2020 | Donnally et al. | |
| 2020/0040674 | A1 | 2/2020 | Mckenzie et al. | |
| 2020/0115969 | A1 | 4/2020 | De Mul et al. | |
| 2021/0246738 | A1 | 8/2021 | Mckenzie et al. | |
| 2021/0293099 | A1 | 9/2021 | Carnegie et al. | |
| 2021/0301602 | A1 | 9/2021 | Mckenzie et al. | |
| 2022/0178215 | A1 | 6/2022 | Donnally et al. | |

FOREIGN PATENT DOCUMENTS

| | | | |
|---|---|---|---|
| CN | 202064839 | | 12/2011 |
| CN | 102979465 | | 3/2013 |
| CN | 103410458 | | 11/2013 |
| CN | 104976322 | | 10/2015 |
| CN | 105113983 | | 12/2015 |
| CN | 108266139 | A | 7/2018 |
| CN | 110792399 | A | 2/2020 |
| EP | 1510302 | | 3/2005 |
| EP | 1953334 | A2 | 8/2008 |
| EP | 3829823 | | 9/2023 |
| GB | 2091788 | A | 8/1982 |
| GB | 2532267 | A | 5/2016 |
| JP | H09137689 | A | 5/1997 |
| NO | 20151648 | A1 | 12/2015 |
| SA | 13499 | B1 | 8/2023 |
| WO | WO-8800274 | A2 | 1/1988 |
| WO | WO-9958811 | A1 | 11/1999 |
| WO | WO-0123701 | A1 | 4/2001 |
| WO | WO-2004018829 | A1 | 3/2004 |
| WO | 2007143842 | | 12/2007 |
| WO | WO-2013082172 | A1 | 6/2013 |
| WO | WO-2014179730 | A1 | 11/2014 |
| WO | WO-2015043740 | A1 | 4/2015 |
| WO | WO-2016024859 | A1 | 2/2016 |
| WO | WO-2016197255 | A1 | 12/2016 |
| WO | WO-2017039996 | A1 | 3/2017 |
| WO | 2017087200 | | 5/2017 |
| WO | WO-2017087595 | A1 | 5/2017 |
| WO | WO-2017190120 | A1 | 11/2017 |
| WO | WO-2017193204 | A1 | 11/2017 |
| WO | WO-2019195651 | A1 | 10/2019 |
| WO | WO-2020028852 | A1 | 2/2020 |
| WO | WO-2020028853 | A1 | 2/2020 |
| WO | WO-2020028853 | A9 | 2/2020 |
| WO | WO-2020028856 | A1 | 2/2020 |
| WO | WO-2020028858 | A1 | 2/2020 |
| WO | 2020123399 | | 6/2020 |
| WO | WO-2020151386 | A1 | 7/2020 |
| WO | 2020160440 | | 8/2020 |
| WO | WO-2020172407 | A1 | 8/2020 |
| WO | WO-2021/203122 | A1 | 10/2021 |
| WO | WO-2021/226622 | A1 | 11/2021 |
| WO | WO-2022/016168 | A1 | 1/2022 |
| WO | 2022170302 | | 8/2022 |

OTHER PUBLICATIONS

"U.S. Appl. No. 16/786,345, Final Office Action dated Jul. 28, 2022", 9 pgs.
"European Application Serial No. 19758551.6, Response filed Aug. 25, 2022 to Communication Pursuant to Article 94(3) EPC dated Apr. 28, 2022", 73 pgs.
"European Application Serial No. 19752902.7, Response filed Aug. 26, 2022 to Communication Pursuant to Article 94(3) EPC dated May 3, 2022", 70 pgs.
"U.S. Appl. No. 16/431,533, Examiner Interview Summary dated Sep. 14, 2022", 3 pgs.
"Saudi Arabia Application No. 521421154, Office Action dated Aug. 31, 2022", w o English translation, 10 pgs.
"U.S. Appl. No. 16/786,345, Response filed Sep. 27, 2022 to Final Office Action dated Jul. 28, 2022", 6 pgs.
"U.S. Appl. No. 16/098,160, Advisory Action dated Jul. 22, 2020", 5 pgs.
"U.S. Appl. No. 16/098,160, Advisory Action dated Aug. 10, 2021", 4 pgs.
"U.S. Appl. No. 16/098,160, Examiner Interview Summary dated Jun. 23, 2020", 3 pgs.
"U.S. Appl. No. 16/098,160, Final Office Action dated Apr. 30, 2020", 7 pgs.
"U.S. Appl. No. 16/098,160, Final Office Action dated May 27, 2021", 8 pgs.
"U.S. Appl. No. 16/098,160, Non Final Office Action dated Sep. 30, 2019", 8 pgs.
"U.S. Appl. No. 16/098,160, Non Final Office Action dated Oct. 6, 2020", 8 pgs.
"U.S. Appl. No. 16/098,160, Preliminary Amendment filed Nov. 1, 2018", 5 pgs.
"U.S. Appl. No. 16/098,160, Response filed Jan. 6, 2021 to Non Final Office Action dated Oct. 6, 2020", 7 pgs.
"U.S. Appl. No. 16/098,160, Response filed Jan. 30, 2020 to Non Final Office Action dated Sep. 30, 2019", 8 pgs.
"U.S. Appl. No. 16/098,160, Response filed Jun. 30, 2020 to Final Office Action dated Apr. 30, 2020", 8 pgs.
"U.S. Appl. No. 16/098,160, Response filed Jul. 27, 2021 to Final Office Action dated May 27, 2021", 9 pgs.
"U.S. Appl. No. 16/098,160, Response filed Aug. 24, 2020 to Advisory Action dated Jul. 22, 2020", 9 pgs.
"U.S. Appl. No. 16/375,927, Advisory Action dated Aug. 11, 2020", 6 pgs.
"U.S. Appl. No. 16/375,927, Corrected Notice of Allowability dated Jan. 26, 2021", 2 pgs.
"U.S. Appl. No. 16/375,927, Examiner Interview Summary dated Apr. 24, 2020", 3 pgs.
"U.S. Appl. No. 16/375,927, Examiner Interview Summary dated Dec. 7, 2020", 7 pgs.
"U.S. Appl. No. 16/375,927, Final Office Action dated Jun. 5, 2020", 10 pgs.
"U.S. Appl. No. 16/375,927, Non Final Office Action dated Feb. 28, 2020", 9 pgs.
"U.S. Appl. No. 16/375,927, Non Final Office Action dated Sep. 24, 2020", 10 pgs.
"U.S. Appl. No. 16/375,927, Notice of Allowance dated Jan. 1, 2021", 8 pgs.
"U.S. Appl. No. 16/375,927, Response filed May 27, 2020 to Non Final Office Action dated Feb. 28, 2020", 10 pgs.
"U.S. Appl. No. 16/375,927, Response filed Aug. 3, 2020 to Final Office Action dated Jun. 5, 2020", 11 pgs.

(56) References Cited

OTHER PUBLICATIONS

"U.S. Appl. No. 16/375,927, Response filed Sep. 8, 2020 to Advisory Action dated Aug. 11, 2020", 10 pgs.
"U.S. Appl. No. 16/375,927, Response filed Dec. 16, 2020 to Non Final Office Action dated Sep. 24, 2020", 8 pgs.
"U.S. Appl. No. 16/431,540, Examiner Interview Summary dated Jan. 19, 2021", 3 pgs.
"U.S. Appl. No. 16/431,540, Final Office Action dated Nov. 19, 2020", 10 pgs.
"U.S. Appl. No. 16/431,540, Non Final Office Action dated Jun. 10, 2020", 13 pgs.
"U.S. Appl. No. 16/431,540, Notice of Allowance dated Feb. 11, 2021", 5 pgs.
"U.S. Appl. No. 16/431,540, Response filed Jan. 19, 2021 to Final Office Action dated Nov. 19, 2020", 11 pgs.
"U.S. Appl. No. 16/431,540, Response Filed Sep. 10, 2020 to Non Final Office Action dated Jun. 10, 2020", 24 pgs.
"U.S. Appl. No. 16/431,540, Supplemental Notice of Allowability dated Mar. 11, 2021", 2 pgs.
"U.S. Appl. No. 16/836,365, Final Office Action dated May 4, 2021", 7 pgs.
"U.S. Appl. No. 16/836,365, Non Final Office Action dated Jan. 25, 2021", 8 pgs.
"U.S. Appl. No. 16/836,365, Notice of Allowance dated Jul. 27, 2021", 7 pgs.
"U.S. Appl. No. 16/836,365, Response filed Apr. 22, 2021 to Non Final Office Action dated Jan. 25, 2021", 8 pgs.
"U.S. Appl. No. 16/836,365, Response filed Jul. 2, 2021 to Final Office Action dated May 4, 2021", 7 pgs.
"Canadian Application Serial No. 3,022,888, Voluntary Amendment filed Jul. 12, 2019", 10 pgs.
"International Application Serial No. PCT/CA2017/000125, International Preliminary Report on Patentability dated Nov. 22, 2018", 6 pgs.
"International Application Serial No. PCT/CA2017/000125, International Search Report dated Aug. 14, 2017", 3 pgs.
"International Application Serial No. PCT/CA2017/000125, Written Opinion dated Aug. 14, 2017", 4 pgs.
"International Application Serial No. PCT/CN2019/124443, International Preliminary Report on Patentability dated May 26, 2021", 4 pgs.
"International Application Serial No. PCT/CN2019/124443, International Search Report dated Mar. 5, 2020", 4 pgs.
"International Application Serial No. PCT/CN2019/124443, Written Opinion dated Mar. 5, 2020", 4 pgs.
"International Application Serial No. PCT/US2019/025942, International Preliminary Report on Patentability dated Oct. 30, 2020", 7 pgs.
"International Application Serial No. PCT/US2019/025942, International Search Report dated Jun. 27, 2019", 4 pgs.
"International Application Serial No. PCT/US2019/025942, Response filed Feb. 5, 2020 to Written Opinion dated Feb. 27, 2019", 14 pgs.
"International Application Serial No. PCT/US2019/025942, Response filed Apr. 23, 2020 to Written Opinion dated Apr. 23, 2020", 14 pgs.
"International Application Serial No. PCT/US2019/025942, Response filed Sep. 22, 2020 to Written Opinion dated Jul. 23, 2020", 4 pgs.
"International Application Serial No. PCT/US2019/025942, Written Opinion dated Feb. 24, 2020", 8 pgs.
"International Application Serial No. PCT/US2019/025942, Written Opinion dated Jun. 27, 2019", 9 pgs.
"International Application Serial No. PCT/US2019/025942, Written Opinion dated Jul. 23, 2020", 5 pgs.
"International Application Serial No. PCT/US2019/044974, International Preliminary Report on Patentability dated Nov. 11, 2020", 7 pgs.
"International Application Serial No. PCT/US2019/044974, International Search Report dated Oct. 24, 2019", 6 pgs.
"International Application Serial No. PCT/US2019/044974, Response filed Jun. 2, 2020 to Written Opinion dated Oct. 24, 2019", 13 pgs.
"International Application Serial No. PCT/US2019/044974, Response filed Aug. 18, 2020 to Written Opinion dated Jun. 19, 2020", 4 pgs.
"International Application Serial No. PCT/US2019/044974, Written Opinion dated Jun. 19, 2020", 7 pgs.
"International Application Serial No. PCT/US2019/044974, Written Opinion dated Oct. 24, 2019", 6 pgs.
"International Application Serial No. PCT/US2019/044976, International Preliminary Report on Patentability dated Mar. 9, 2021", 7 pgs.
"International Application Serial No. PCT/US2019/044976, International Search Report dated Oct. 18, 2019", 5 pgs.
"International Application Serial No. PCT/US2019/044976, Response filed Jun. 3, 2020 to Written Opinion dated Oct. 18, 2019", 11 pgs.
"International Application Serial No. PCT/US2019/044976, Response filed Aug. 25, 2020 to Written Opinion dated Jun. 26, 2020", 3 pgs.
"International Application Serial No. PCT/US2019/044976, Written Opinion dated Jun. 26, 2020", 4 pgs.
"International Application Serial No. PCT/US2019/044976, Written Opinion dated Oct. 18, 2019", 8 pgs.
"International Application Serial No. PCT/US2019/044976, Written Opinion dated Nov. 6, 2020", 6 pgs.
"International Application Serial No. PCT/US2019/044979, International Preliminary Report on Patentability dated Nov. 18, 2020", 7 pgs.
"International Application Serial No. PCT/US2019/044979, International Search Report dated Oct. 22, 2019", 6 pgs.
"International Application Serial No. PCT/US2019/044979, Response filed Jun. 3, 2020 to Written Opinion dated Oct. 22, 2019", 12 pgs.
"International Application Serial No. PCT/US2019/044979, Response filed Aug. 25, 2020 to Written Opinion dated Jun. 26, 2020", 3 pgs.
"International Application Serial No. PCT/US2019/044979, Written Opinion dated Jun. 26, 2020", 4 pgs.
"International Application Serial No. PCT/US2019/044979, Written Opinion dated Oct. 22, 2019", 7 pgs.
"International Application Serial No. PCT/US2019/044983, International Preliminary Report on Patentability dated Feb. 18, 2021", 8 pgs.
"International Application Serial No. PCT/US2019/044983, International Search Report dated Oct. 22, 2019", 5 pgs.
"International Application Serial No. PCT/US2019/044983, Written Opinion dated Oct. 22, 2019", 6 pgs.
"International Application Serial No. PCT/US2019/124443, Response filed Nov. 24, 2020 to Written Opinion dated Mar. 5, 2020", 10 pgs.
"International Application Serial No. PCT/US2020/019039, International Search Report dated May 15, 2020", 2 pgs.
"International Application Serial No. PCT/US2020/019039, Written Opinion dated May 15, 2020", 4 pgs.
"International Application Serial No. PCT/US2021/070319, International Search Report dated May 31, 2021", 5 pgs.
"International Application Serial No. PCT/US2021/070319, Written Opinion dated May 31, 2021", 6 pgs.
"International Application Serial No. PCT/US2021/070488, Invitation to Pay Additional Fees dated Jun. 28, 2021", 2 pgs.
"Moveit—Kinematic constraints: Visibility Constraint Class Reference", [online]. [retrieved Apr. 21, 2021]. Retrieved from the Internet: <URL: http://docs.ros.org/en/hydro/api/moveit_core/html/classkinematic_constraints_1_1VisibilityConstraint.html>, (2021), 8 pgs.
"Moveit-Moving robots into the future", [online]. [archived Dec. 4, 2020]. Retrieved from the Internet: < URL: https://web.archive.org/web/20201204224545/https://moveit.ros.org/>, (2020), 7 pgs.
"International Application Serial No. PCT US2022 070377, International Search Report dated Mar. 25, 2022", 5 pgs.
"International Application Serial No. PCT US2022 070377, Written Opinion dated Mar. 25, 2022", 7 pgs.
"Saudia Arabian Application No. 521421161, Office Action dated Mar. 31, 2022", (w English Summary), 6 pgs.
"U.S. Appl. No. 16/431,533, Response Filed May 16, 2022 to Non Final Office Action dated Feb. 14, 2022", 11 pgs.
"U.S. Appl. No. 17/248,669, Corrected Notice of Allowability dated May 18, 2022", 3 pgs.
"European Application Serial No. 19758551.6, Communication Pursuant to Article 94(3) EPC dated Apr. 28, 2022", 4 pgs.

(56) References Cited

OTHER PUBLICATIONS

"European Application Serial No. 19752902.7, Communication Pursuant to Article 94(3) EPC dated May 3, 2022", 5 pgs.
"International Application Serial No. PCT US2021 070319, International Preliminary Report on Patentability dated May 10, 2022", 7 pgs.
"U.S. Appl. No. 16/786,345, Response filed Jun. 15, 2022 to Non Final Office Action dated Mar. 28, 2022", 12 pgs.
"U.S. Appl. No. 16/098,160, Non-Final Office Action dated Sep. 15, 2021", 8 pgs.
"U.S. Appl. No. 16/098,160, Response filed Aug. 27, 2021 to Advisory Action dated Aug. 10, 2021", 8 pgs.
"U.S. Appl. No. 16/098,160, Response filed Dec. 14, 2021 to Non-Final Office Action dated Sep. 15, 2021", 8 pgs.
"U.S. Appl. No. 16/836,365, Notice of Allowance dated Nov. 3, 2021", 7 pgs.
"U.S. Appl. No. 17/248,669, Examiner Interview Summary dated Dec. 17, 2021", 2 pgs.
"U.S. Appl. No. 17/248,669, Non-Final Office Action dated Oct. 5, 2021", 8 pgs.
"International Application Serial No. PCT/US2020/019039, International Preliminary Report on Patentability dated Sep. 2, 2021", 6 pgs.
"International Application Serial No. PCT/US2021/070488, International Search Report dated Sep. 8, 2021", 4 pgs.
"International Application Serial No. PCT/US2021/070488, Written Opinion dated Sep. 8, 2021", 6 pgs.
"International Application Serial No. PCT/US2021/070786, International Search Report dated Nov. 9, 2021", 4 pgs.
"International Application Serial No. PCT/US2021/070786, Invitation to Pay Additional Fees dated Sep. 1, 2021", 2 pgs.
"International Application Serial No. PCT/US2021/070786, Written Opinion dated Nov. 9, 2021", 7 pgs.
"U.S. Appl. No. 16/786,345, Corrected Notice of Allowability dated Sep. 20, 2023", 3 pgs.
"U.S. Appl. No. 16/786,345, Notice of Allowance dated Aug. 31, 2023", 6 pgs.
"U.S. Appl. No. 16/786,345, Response filed Aug. 23, 2023 to Final Office Action dated May 30, 2023", 7 pgs.
"U.S. Appl. No. 17/250,548, Restriction Requirement dated Aug. 21, 2023", 6 pgs.
"U.S. Appl. No. 17/310,188, Non Final Office Action dated Sep. 11, 2023", 14 pgs.
"U.S. Appl. No. 16/786,345, Final Office Action dated Oct. 24, 2022", 8 pgs.
"U.S. Appl. No. 16/431,533, Response filed Oct. 21, 2022 to Final Office Action dated Jul. 21, 2022", 9 pgs.
"U.S. Appl. No. 16/431,533, Notice of Allowance dated Nov. 7, 2022", 8 pgs.
"U.S. Appl. No. 16/431,533, Corrected Notice of Allowability dated Nov. 16, 2022", 2 pgs.
"U.S. Appl. No. 16/786,345, Advisory Action dated Dec. 30, 2022", 3 pgs.
"U.S. Appl. No. 16/786,345, Non Final Office Action dated Jan. 19, 2023", 7 pgs.
"International Application Serial No. PCT US2022 070377, Written Opinion of the International Preliminary Search Authority dated Jan. 12, 2023", 8 pgs.
"U.S. Appl. No. 16/786,345, Response filed Apr. 19, 2023 to Non Final Office Action dated Jan. 19, 2023", 8 pgs.
"International Application Serial No. PCT US2022 070377, International Preliminary Report on Patentability dated Apr. 4, 2023", 8 pgs.
"U.S. Appl. No. 16/786,345, Final Office Action dated May 30, 2023", 7 pgs.
"European Application Serial No. 21719521.3, Communication Pursuant to Article 94(3) EPC dated Jul. 17, 2023" 3 pgs.
"U.S. Appl. No. 17/250,548, Response filed Oct. 4, 2023 to Restriction Requirement dated Aug. 21, 2023", 6 pgs.
"U.S. Appl. No. 17/310,188, Response filed Oct. 17, 2023 to Non Final Office Action dated Sep. 11, 2023", 9 pgs.
"U.S. Appl. No. 17/250,548, Non Final Office Action dated Oct. 20, 2023", 9 pgs.
"U.S. Appl. No. 17/310,188, Notice of Allowance dated Nov. 1, 2023", 7 pgs.
"U.S. Appl. No. 16/098,160, Corrected Notice of Allowability dated Mar. 25, 2022", 4 pgs.
"U.S. Appl. No. 16/098,160, Notice of Allowance dated Feb. 3, 2022", 7 pgs.
"U.S. Appl. No. 16/431,533, Non Final Office Action dated Feb. 14, 2022", 15 pgs.
"U.S. Appl. No. 16/786,345, Non Final Office Action dated Mar. 28, 2022", 13 pgs.
"U.S. Appl. No. 17/248,669, 312 Amendment filed Mar. 2, 2022", 3 pgs.
"U.S. Appl. No. 17/248,669, Notice of Allowability dated Feb. 3, 2022", 5 pgs.
"U.S. Appl. No. 17/248,669, Notice of Allowance dated Jan. 25, 2022", 8 pgs.
"U.S. Appl. No. 17/248,669, PTO Response to Rule 312 Communication dated Mar. 9, 2022", 2 pgs.
"U.S. Appl. No. 17/248,669, Response filed Jan. 5, 2022 to Non-Final Office Action dated Oct. 5, 2021", 8 pgs.
"U.S. Appl. No. 17/250,548, Final Office Action dated Jan. 12, 2024", 9 pgs.
"U.S. Appl. No. 17/250,548, Response filed Jan. 3, 2024 to Non Final Office Action dated Oct. 20, 2023", 10 pgs.
"U.S. Appl. No. 17/310,188, Corrected Notice of Allowability dated Dec. 6, 2023", 3 pgs.
"European Application Serial No. 21719521.3, Communication Pursuant to Article 94(3) EPC dated Nov. 21, 2023", 4 pgs.
"European Application Serial No. 21719521.3, Response filed Oct. 29, 2023 to Communication Pursuant to Article 94(3) EPC dated Jul. 17, 2023", 74 pgs.

* cited by examiner

DUAL ACTIVITY TOP DRIVE

CLAIM OF PRIORITY

This patent application is a U.S. National Stage Filing under 35 U.S.C. 371 from International Application No. PCT/US2020/019039 filed on Feb. 20, 2020, which claims the benefit of priority to U.S. Provisional Application Ser. No. 62/809,093, filed Feb. 22, 2019, each of which are incorporated by reference herein in their entirety.

TECHNOLOGICAL FIELD

The present application relates to top drives of drill rigs. More particularly, the present application relates to the pipe handling features of a top drive of a drill rig. Still more particularly, the present application relates to a top drive having dual pipe handling tools and, in particular, a top drive with dual pipe handling elevators.

BACKGROUND

The background description provided herein is intended to generally present the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

In days of old, many drill rigs included a rotary table that functioned together with a swivel and a Kelly system. The swivel operated to hold a length of drill pipe in position above a drill string and allow the pipe to swivel. The rotary table and the Kelly system was used to rotate the drill pipe to secure it to the drill string. An alternative to this approach has been around for some time and is called a top drive. In contrast to the Kelly system, the top drive can hold a length of drill pipe or several connected segments of drill pipe while also rotating the drill pipe and, as such, does not need to rely on a Kelly system to rotate the drill pipe.

The process of tripping drill pipe into and/or out of a well involves engaging the drill string with the top drive for a period of time and holding the drill string with a rotary table while the top drive is used to fetch additional lengths of pipe. That is, for example, the top drive may hold the top of a drill string with an elevator during drilling operations or when otherwise tripping pipe into a well. When the top of the drill string approaches the drill floor, the slips may be inserted and a rotary table may engage and hold the drill string, such that the top drive elevators can release the drill string and be used to retrieve an additional length of drill pipe. The additional drill pipe may be retrieved, stabbed into the top of the drill string and secured, and then drilling operations may continue and/or the string may be inserted further into the already drilled well. The process of retrieving additional drill pipe involves releasing the drill string with the top drive elevators, swinging the elevators to a clearance position, raising the elevators to a point higher than pipe or pipe stand to be retrieved, further swinging the elevators into position above the pipe or pipe stand to be retrieved, and lowering the elevators to secure the pipe or pipe stand. Once secured, the pipe or pipe stand can be lifted to a vertical position, moved to well center, stabbed into the drill string, and connected with a roughneck. This process is relatively time consuming and cumbersome.

SUMMARY

The following presents a simplified summary of one or more embodiments of the present disclosure in order to provide a basic understanding of such embodiments. This summary is not an extensive overview of all contemplated embodiments, and is intended to neither identify key or critical elements of all embodiments, nor delineate the scope of any or all embodiments.

In one or more embodiments, a dual activity top drive may include a mechanized system configured for suspension from a traveling block of a drill rig and for engaging and rotating a drill string from the top of the drill string. The top drive may also include a primary pipe handling system suspended from the mechanized system and configured for handling a pipe string. The top drive may also include an auxiliary pipe handling system suspended from the mechanized system and configured for handling a segment of pipe to be added or removed from the pipe string.

In one or more other embodiments, a method of tripping drill pipe may include using a top drive on a drill rig and advancing a drill string into a well bore while securing the drill string with a primary pipe handling system. The method may further include, while advancing the drill string, pivoting an auxiliary pipe handling system into position for retrieving an additional pipe to be added to the drill string.

In one or more embodiments, a drill rig may include a top drive suspended from a travelling block of the drill rig. The top drive may include a mechanized system configured for engaging and rotating a drill string from the top of the drill string. The top drive may also include a primary pipe handling system suspended from the mechanized system and configured for handling a pipe string. The top drive may also include an auxiliary pipe handling system suspended from the mechanized system and configured for handling a segment of pipe to be added or removed from the pipe string.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

The present application, in one or more embodiments, includes a drill rig with a dual activity top drive. That is, the top drive may include a primary elevator and an auxiliary elevator for streamlining tripping operations. The primary elevator may be used to hold the drill string when the drill string is being run into the well. The auxiliary elevator may be used to approach and retrieve a new drill pipe or pipe stand as the top drive is approaching the drill floor. In particular, the auxiliary elevator may be used to retrieve single pipes, double stands, or triple stands from a pipe cat. The pipe cat or other pipe delivery system may include pipe that is arranged generally horizontally and/or with some slope. The auxiliary elevator may help to allow engagement with additional drill pipe prior to securing the drill string with the drill floor, whereas the primary elevator may not be able to do so because it may avoid releasing the drill string until it is secured at the drill floor. This type of top drive may allow the new drill pipe or pipe stand to be immediately lifted to a vertical position and brought to well center when the primary elevator releases the drill string. In particular, the top drive herein may avoid the process relating to repositioning the primary elevator to retrieve additional drill pipe. This approach to tripping drill pipe may increase the efficiency of tripping operations. For example, making and/or breaking connections between drill pipe and the drill string may be performed approximately 30 seconds faster each time. Over the course of thousands of feet of drill pipe, with connections every 30 to 90 feet, this saves large amounts of time.

Figure 1:
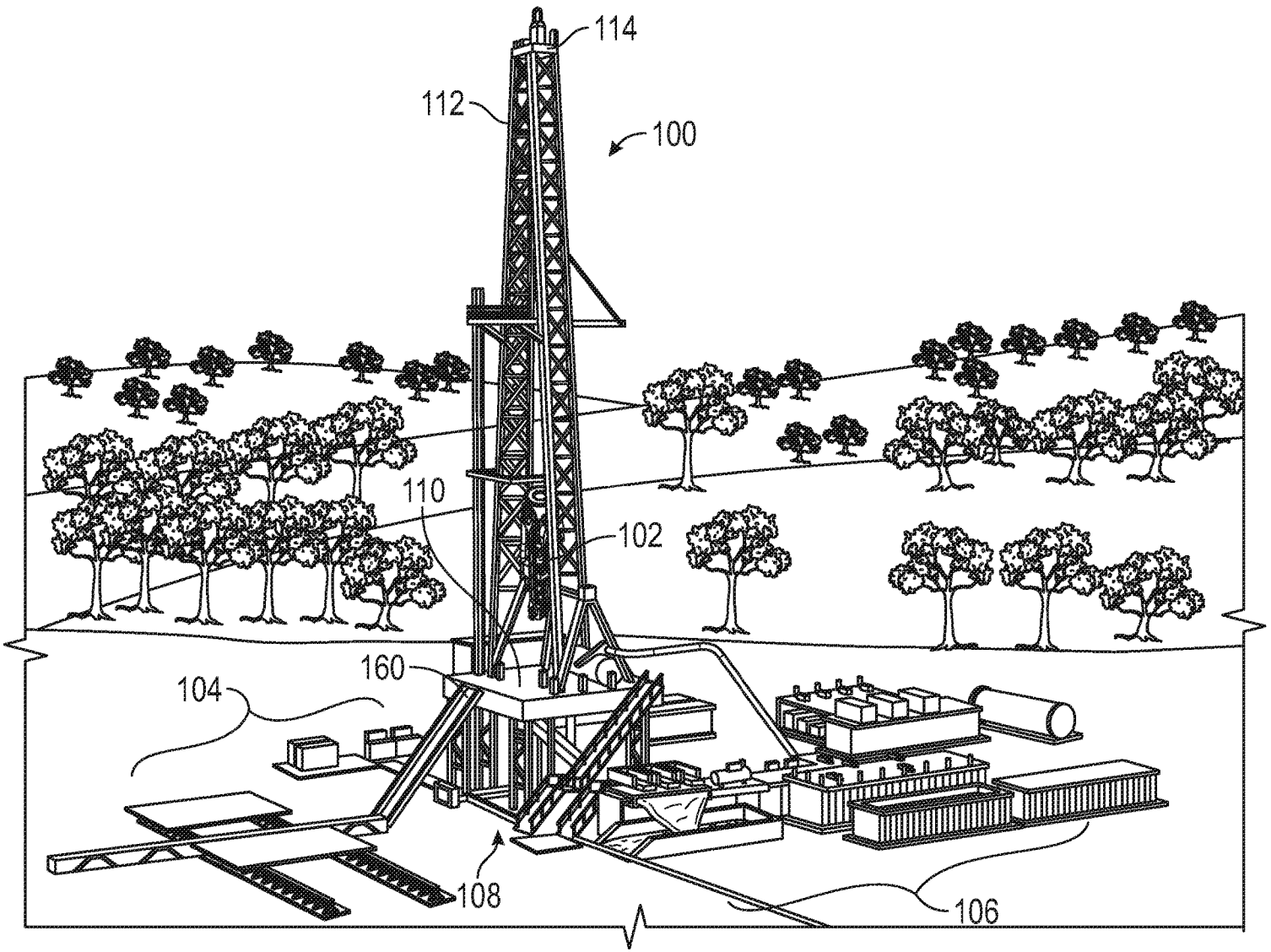
FIG. 1 is a perspective view of a drill rig having a dual activity top drive, according to one or more embodiments.

Referring now to FIG. 1, a rig 100 with a dual activity top drive 102 is shown. As shown, the rig 100 may be placed at a well site and may be adapted for drilling a well. The rig 100 may be part of a larger system of equipment including drill fluid recycling systems 106 a drill pipe handling apparatus 104 and the like. The drill rig 100 may include a base 108 for supporting the rig 100 on a surface, a drill floor 110 for, among other things, personnel to make and/or disconnect drill pipe connections, and a mast 112 for supporting the drill string manipulation equipment such as a top drive 102. The drill rig 100 may also include a draw works for handling a lifting line system 120. The lifting line system may include a wireline extending from the draw works to a crown block 114 at or near the top of the mast. The lifting line system may also include a traveling block 116 with a hook 118. The lifting line 120 may be reeved through the crown block 114 and lifting block to reduce the load on the line and allow for managing large loads with the traveling block 116. A top drive 102 may be suspended from the traveling block 116 and it may be used for manipulating and/or controlling the drill string as well as adding or removing drill pipe from the drill string.

Figure 2:
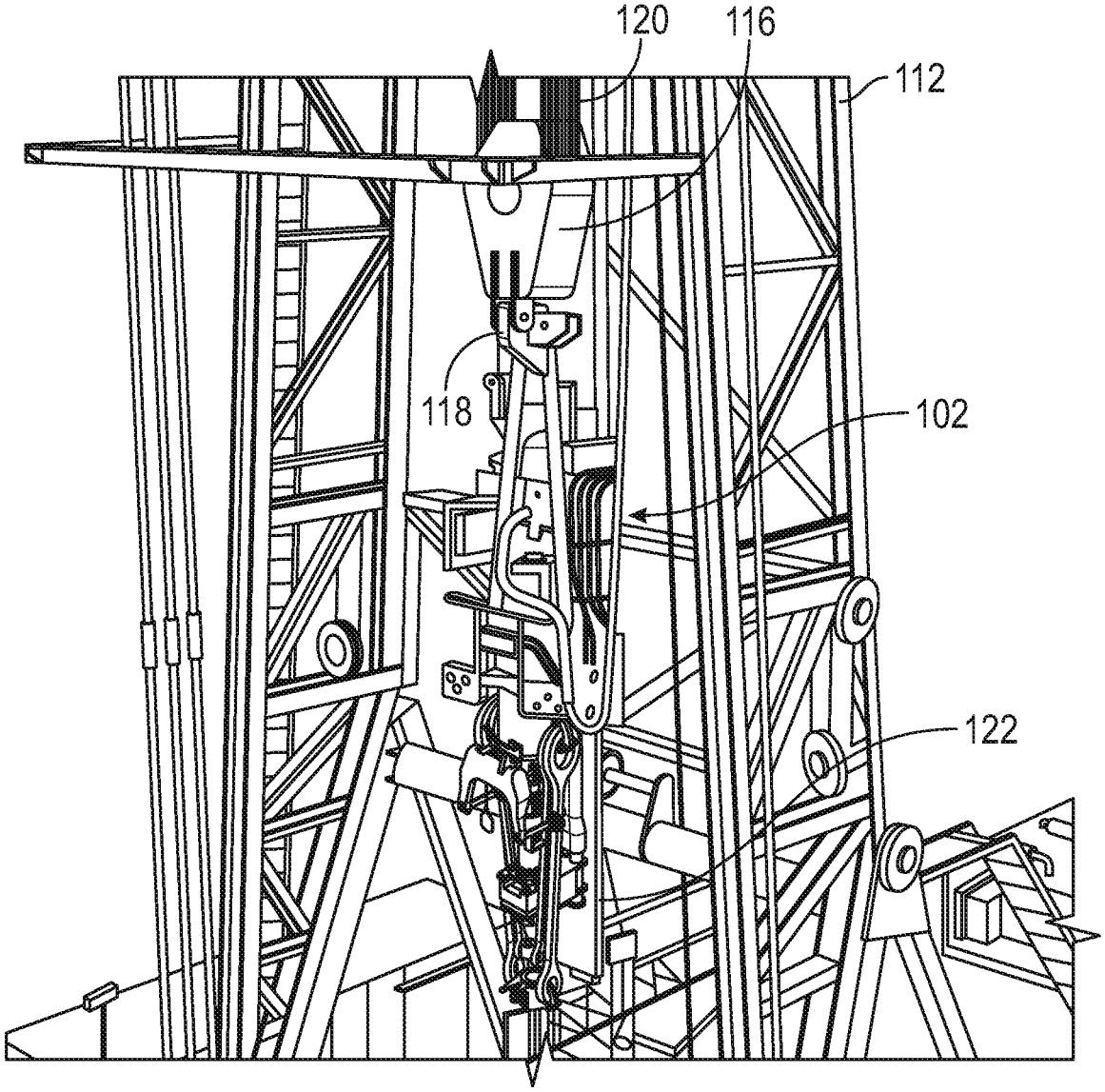
FIG. 2 is a closer perspective view of the dual activity top drive of the rig of FIG. 1, according to one or more embodiments.

FIG. 2 is a closer view of the rig of FIG. 1 showing the top drive 102. As shown, the top drive 102 may be suspended from the crown block 116 of the rig 100 with a hook and a laterally and rotationally stabilizing guide beam 122 may be provided. The top drive 102 may be a mechanized system configured for lifting sections of drill pipe or pipe stands to connect or disconnect the sections or stands from the drill string. The top drive may also be configured for carrying, supporting, and/or manipulating the entire drill string during drilling operations and/or during tripping of the drill string into or out of the well. Still further, the top drive may be configured for delivering drilling fluid to the drill string to control drilling operations within the well.

Figure 3:
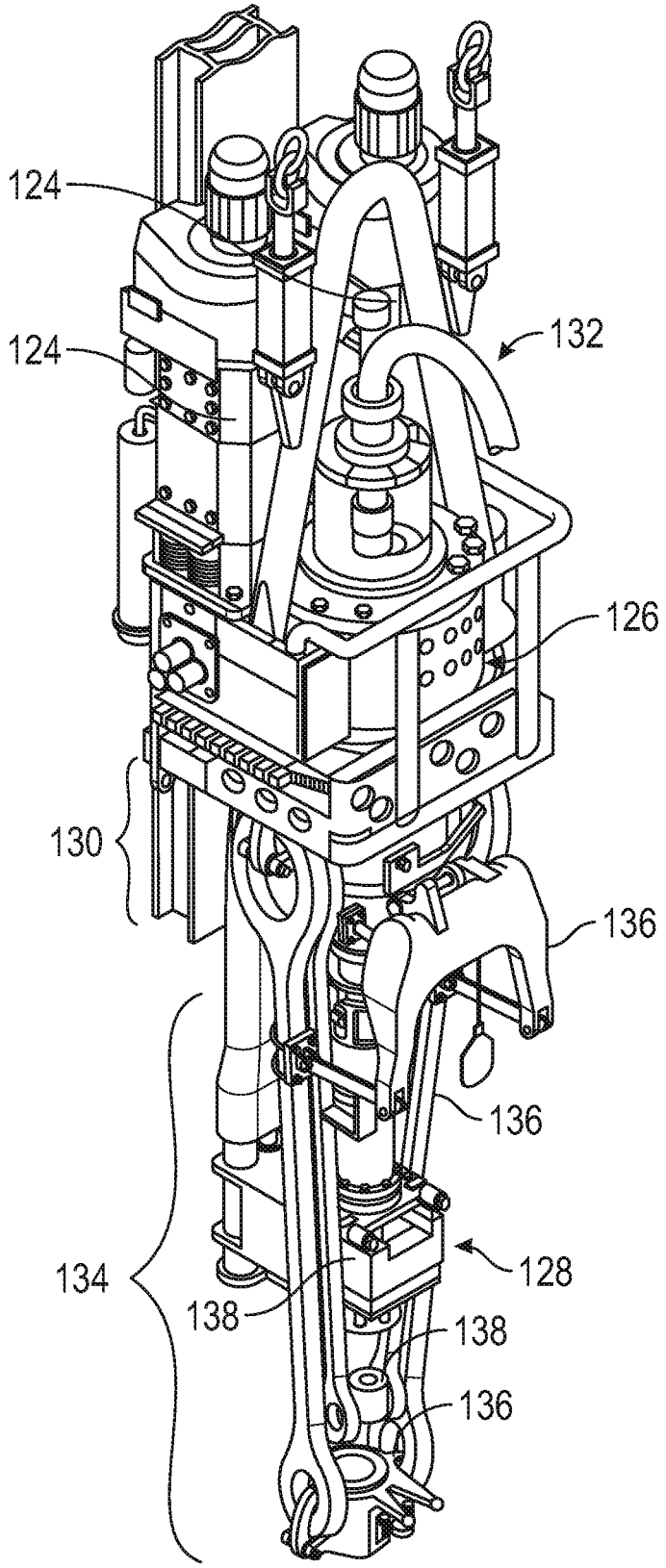
FIG. 3 is a perspective view of the dual activity top drive of the rig of FIG. 1, according to one or more embodiments.

Turning now to FIG. 3, a perspective view of the top drive 102 is shown. As shown, the top drive 102 may be configured for managing drill pipe operations while being suspended from the travelling block 116 and travelling up and down along the guide beam 122. Broadly speaking, the top drive 102 may include a drive or drilling motor 124, a transmission 126, an engagement element 128, a carriage and guide beam 130, a mud handling system 132, and a pipe handling portion 134. The drive or drilling motor 124 may provide rotational power to the drill pipe being handled by the top drive. In the case of adding additional drill pipe to the top of a pipe string, the drive or drilling motor may rotate the additional pipe to make up a joint. In the case of drilling, the drive or drilling motor may rotate the entire pipe string during drilling operations. The transmission 126 may allow for adjusting the speed and/or power of the drive or drilling motor depending on the operation being performed. The engagement element 128 may be adapted to receive and engage the top end of a length of drill pipe or a pipe stand. The engagement element 128 may include an adjustable stabbing guide for guiding the top end of the drill pipe or pipe stand into the top drive allowing the top drive to grasp the pipe. The engagement element 128 may include a receiving sleeve for receiving the top end of the drill pipe or stand and may threadably or graspingly engage the top end of the drill pipe or pipe stand. As the top drive moves up and down on the drill rig, a carriage on the top drive may engage a guide beam to maintain the alignment of the top drive with well center. The mud handling system 132 may function to deliver drilling fluid to the drill string during drilling operations and may allow for stopping the flow of fluid to the drill string when making up or breaking pipe joints. The mud handling system 132 may be in fluid communication with a drill fluid recycling system that may function to clean fluid leaving the well allowing for reuse of the fluid. The pipe handling portion 134 may function to handle and engage additional drill pipe or pipe stands being added or removed from the drill string and/or to engage the top of the drill string. The pipe handling portion 134 may be described in a greater amount of detail.

Figure 4:
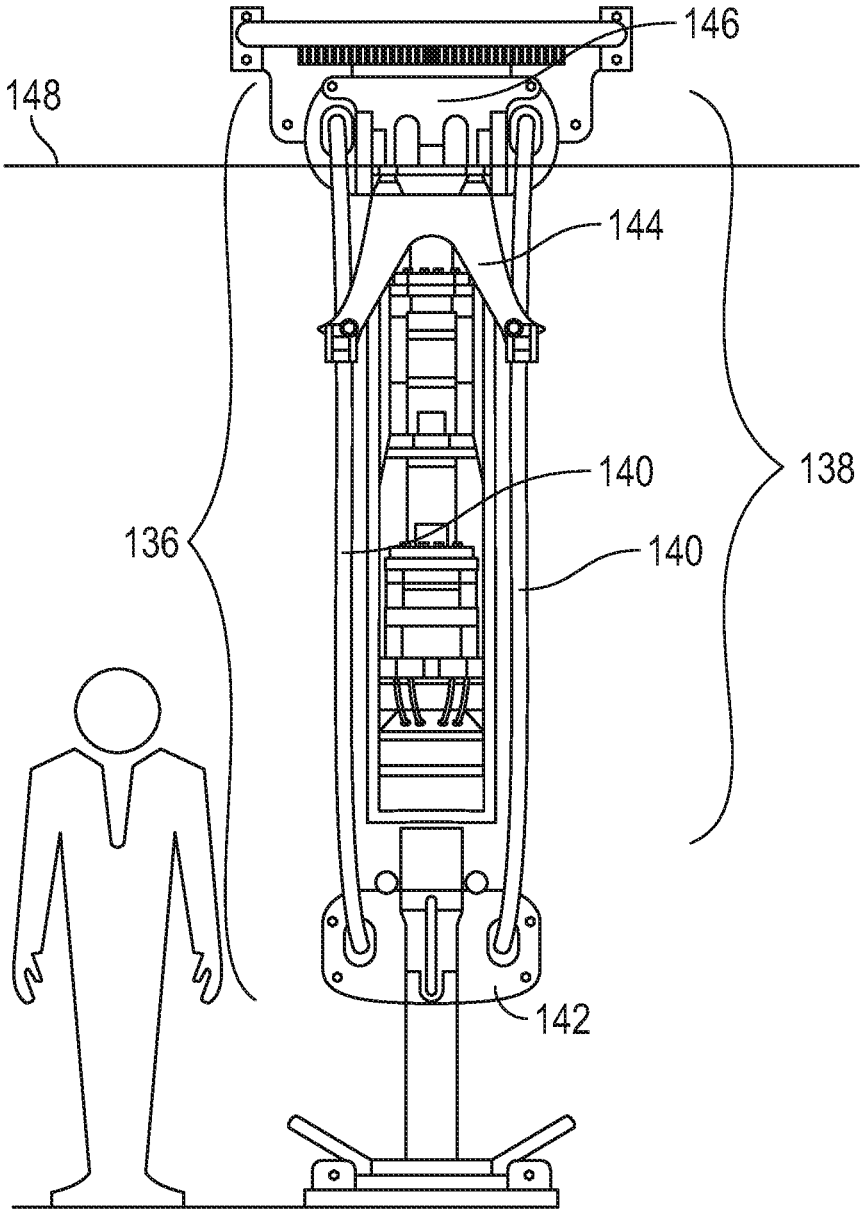
FIG. 4 is a front view of a pipe handling portion of the dual activity top drive of the rig of FIG. 1, according to one or more embodiments.
Figure 5:
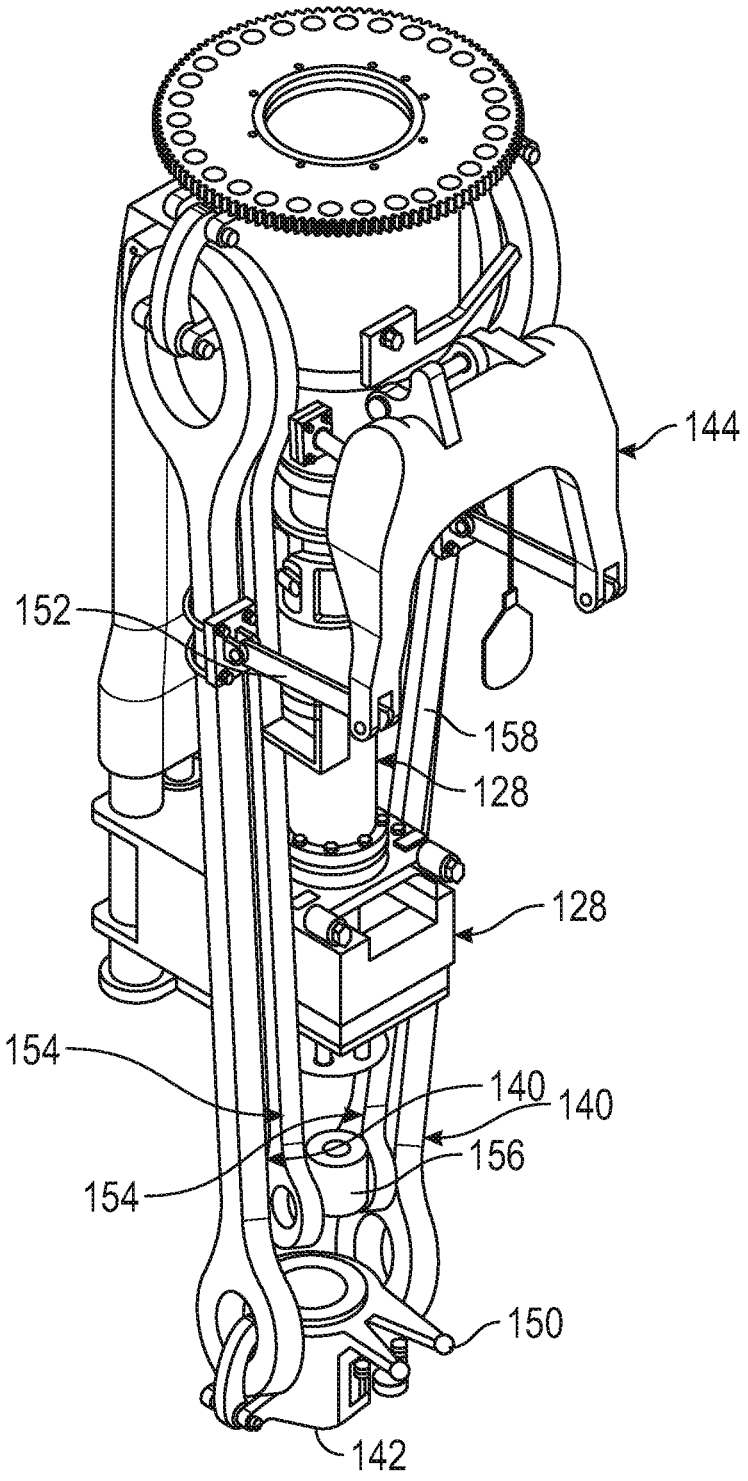
FIG. 5 is a perspective view of a pipe handling portion of the dual activity top drive of the rig of FIG. 1, according to one or more embodiments.

As shown in FIGS. 4 & 5, the pipe handling portion 134 may be adapted for retrieving drill pipe in the form of individual sections of pipe or double or triple stands of pipe, for example, and bringing them into alignment with the engagement portion as well as maintaining control of the pipe sections and/or the entire pipe string. The single, double, or triple stands of pipe may be arranged on a pipe cat or other means of horizontal or near horizontal presentation of tubulars. As shown, the pipe handling portion may include a primary system 136 and an auxiliary system 138. In one or more embodiments, the primary system 136 may be adapted for handling the pipe string and the auxiliary system 138 may be adapted for handling additional pipe sections or pipe stands.

The primary system 136 may include a pair of links or bails 140, an elevator 142, and a bail positioning device 144. The pair of links MO may be pivotally supported on the top drive and may hang generally vertically on each side of the pipe engagement portion 128. The top of each link may be pivotally secured to a shoulder 146 at or above the pipe engaging portion, such that the links may pivot about a substantially horizontal axis 148 extending through the top drive. The axis 148 may be in a plane offset from, but generally parallel to, the guide beam such that pivoting motion of the links causes the bottom end of the links to move toward and/or away from the plane of the guide beam. The links 140 may, thus, be adapted to swing or pivot out of alignment of the top drive in a direction toward or away from plane of the guide beam allowing the primary system to access pipes that are arranged adjacent and/or to the side of well center. The links may include substantially solid rods configured for managing relatively high tensile loads from the pipe string. Each link may include an eye or eyelit at the top for pivotally engaging top drive and an additional eye or eyelit at the bottom for pivotally supporting the elevator.

A pipe elevator 142 may be arranged at a bottom end of the links or bails 140. The pipe elevator 142 may be adapted to grasp drill pipe or pipe stands. In particular, the pipe elevator 142 may include a jaw-like mechanism configured to pivotally open allowing the elevator to be placed around a drill pipe or stand and closed around the pipe or stand to grasp the pipe or stand. Each jaw of the pipe elevator may include a semi-circular surface for engaging the outside curved surface of the drill pipe. In one or more embodiments, the open end of the pipe elevator may include a lever or clamping mechanism 150 for pulling the open ends of the elevator together to tightly grasp the pipe. In one or more embodiments, the closing of the elevator may include hydraulics for hydraulically clamping the two jaws closed around the pipe. The pipe elevator may be pivotally engaged with the links or bails allowing the pipe elevator to pivot about a substantially horizontal axis. The pipe elevator may be pivotally engaged by way of loops or other mechanisms engaging the bottom eye or eyelit of the links.

The bail positioning device 144 may be adapted to pivot the links 140 about the pivot axis and, as such, allow the handling system to swing the pipe elevator front to back relative to the guide assembly via the links/bails. The bail positioning device 144 may include an inverted U-shaped plate, bracket, or arm as shown. The bracket may be adapted to pivot about its top end such that the legs of the bracket swing front to back alongside the top drive. The bail positioning device 144 may include a push/pull linkage 152 extending generally rearwardly from the end of each leg of the bracket. The push/pull linkage 152 may be pivotally secured to a respective bracket leg and a link. The bracket legs may be substantially shorter than the length of the links and, as such, may have a much shorter radius of swing. The push/pull linkage may, thus, engage the link below the top of the link, but substantially toward the top end where very little motion forward or backward induces much more motion at the bottom end of the links. The bracket may be wide enough to allow the legs of the bracket to clear the sides of the top drive allowing for a relatively large range of motion of the bracket. The bracket may be hydraulically driven or another mode of mechanical movement such as a drive gear or other mechanism may be used.

As mentioned, the top drive may also include an auxiliary pipe handling system 138. The auxiliary pipe handling system 138 may include the same or similar features as the primary handling system 136. That is, the auxiliary system 138 may include a pair of links or bails 154, an elevator 156, and a bail positioning device 158. The auxiliary system may be arranged on the top drive to supplement the primary system 136 and to avoid interfering with the primary system 136. In one or more embodiments, the auxiliary system 138 may be nested within the primary system where the elevator of the auxiliary system is above the elevator of the primary system. Alternatively, the auxiliary system may be arranged around or outside the primary system where the elevator of the auxiliary system is below the elevator of the primary system.

In the nested configuration, the auxiliary pipe handling system 138 may include a pair of links or bails 154 arranged toward an inboard side of the links/bails of the primary system. That is, the link/bails 154 of the auxiliary system may be secured to the shoulder at a position closer to the center of the top drive and, as such, the links/bails of the auxiliary system may hang vertically within the links/bails of the primary system. The elevator 156 of the auxiliary system may be slightly smaller than the elevator of the primary system and may, thus, fit within the links/bails of the primary system. The elevator 156 of the auxiliary system may be secured to the bottom end of the links/bails of the auxiliary system and such links may be shorter than the link/bails of the primary system such that the auxiliary elevator is arranged above the primary system elevator. It may be appreciated that where the auxiliary system is used for additional pipes or pipe stands rather than the full drill string, the loading demands of the auxiliary system may be much less than that of the primary system and smaller components may be used. The bail positioning device 158 of the auxiliary system 138 may be arranged below the bail positioning device 144 of the primary system 136 and may have a bracket that is narrower to avoid interfering with the bail positioning system of the primary system. In one or more other embodiments, the bail positioning 158 system may be arranged on an opposing side of the top drive. In still other embodiments, the bail positioning system of the auxiliary system may be arranged above the bail positioning system of the primary system.

Where the auxiliary system 138 is arranged around or outside the primary system 136, the links/bails 154 may be outboard the links/bails 140 of the primary system 136. The links/bails 154 of the auxiliary system 138 may be longer than the links/bails 140 of the primary system 136 and, as such, the elevator 156 of the auxiliary system may be arranged below the elevator 142 of the primary system 136. A bail positioning device may be provided that straddles the primary system.

Figure 6:
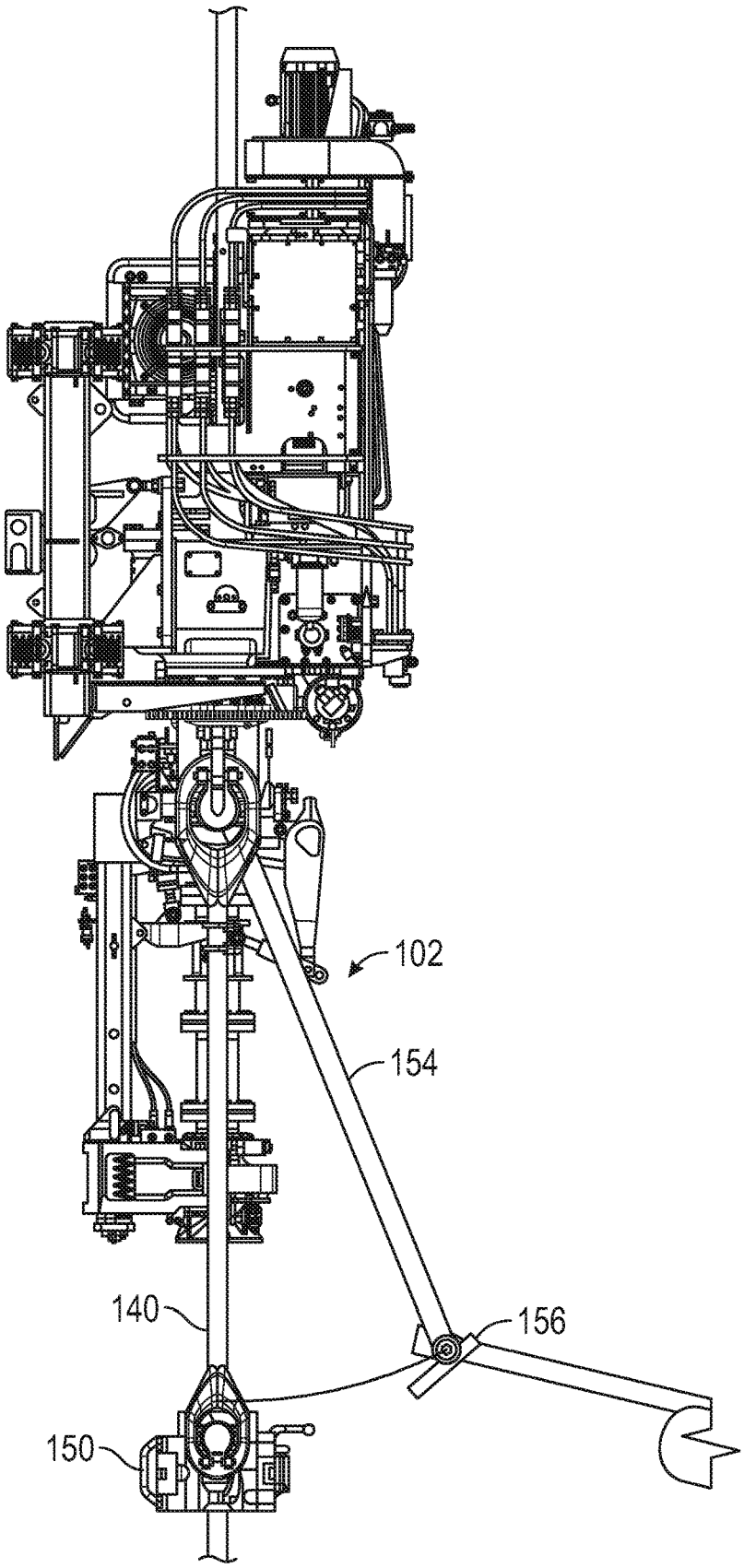
FIG. 6 is a side view of the dual activity top drive of the rig of FIG. 1 with the auxiliary elevator secured to an incoming portion of drill pipe, according to one or more embodiments.

The presence of an auxiliary pipe handling system 138 may allow for new and improved approaches to drilling and to tripping drill pipe into and out of a well. As shown in FIG. 6, the auxiliary pipe handling system 138 may swing out above additional pipe to be retrieved while the primary pipe handling system 136 maintains engagement with the drill string. A close up view of this may be seen in FIG. 7. As shown, the links/bails of the auxiliary system may be swung out and the elevator may be clamped or secured to an additional pipe to be retrieved. As shown, the auxiliary elevator may be pivoted relative to the auxiliary links/bails such that the elevator may be positioned across the pipe and clamp the pipe. This may be performed while the primary elevator remains clamped or secured to the drill string, for example.

Figure 7:
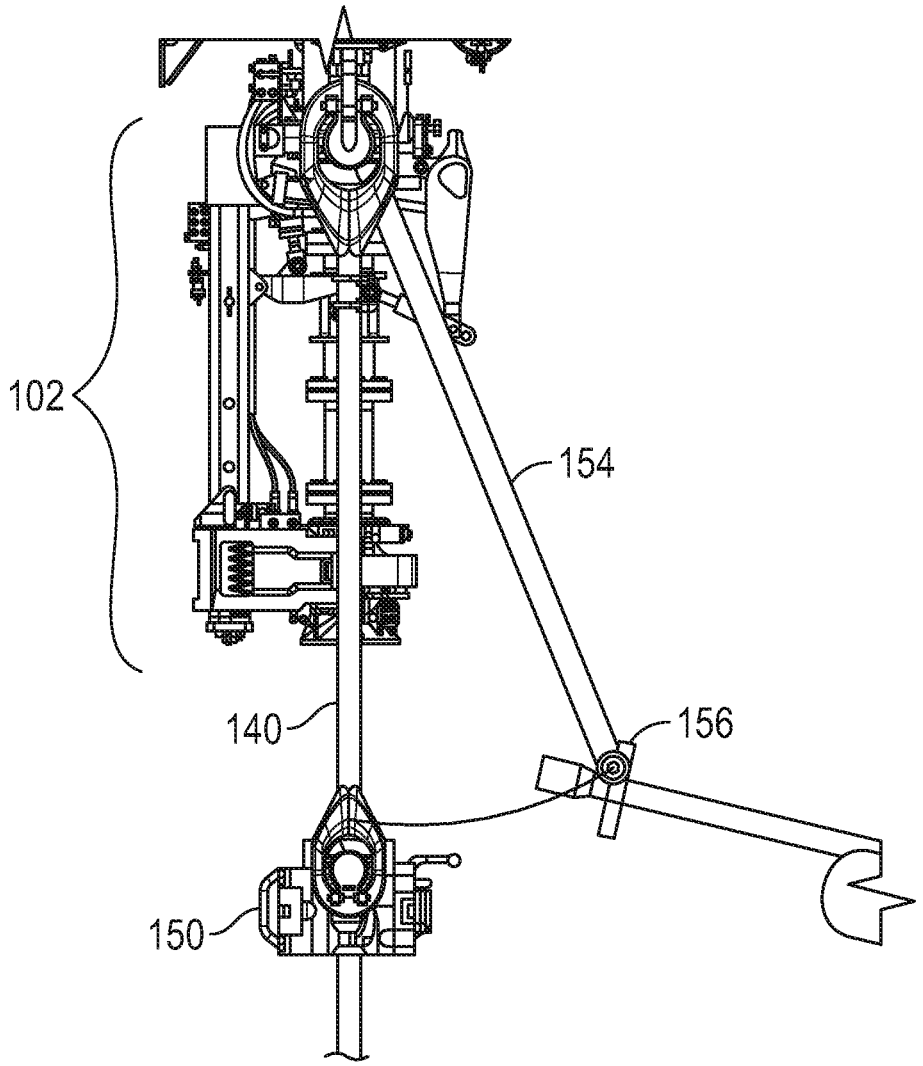
FIG. 7 is a close up view thereof.

It is to be appreciated that drill pipe is commonly delivered to a drill rig using a pipe rack and a V-door 160. That is as shown in FIG. 1, a pipe rack and delivery system 104 may be provided at or adjacent to a drill rig. The pipe rack and delivery system 104 may include a ramp, guide, or conveyor for guiding or conveying the front/top of drill pipe upward and to the drill floor. The pipe may be dragged or conveyed up the ramp exposing the top portion of the pipe slightly above the height of the drill floor and as shown in FIGS. 6 and 7. This places the drill pipe in condition for retrieval by the top drive.

Figure 8:
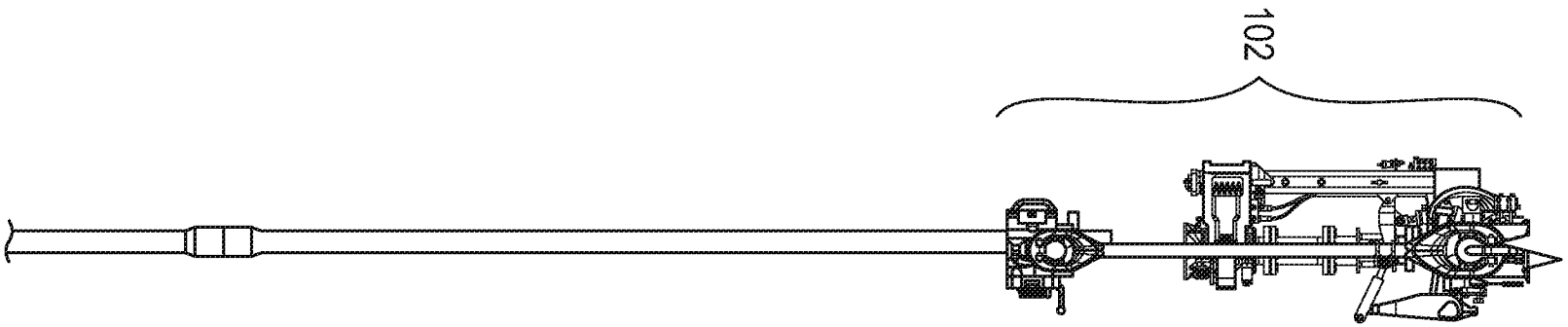
FIG. 8 is a side view of a dual activity top drive in place on a drill string with a top length of drill pipe stabbed into the drill string, according to one or more embodiments.
Figure 9:
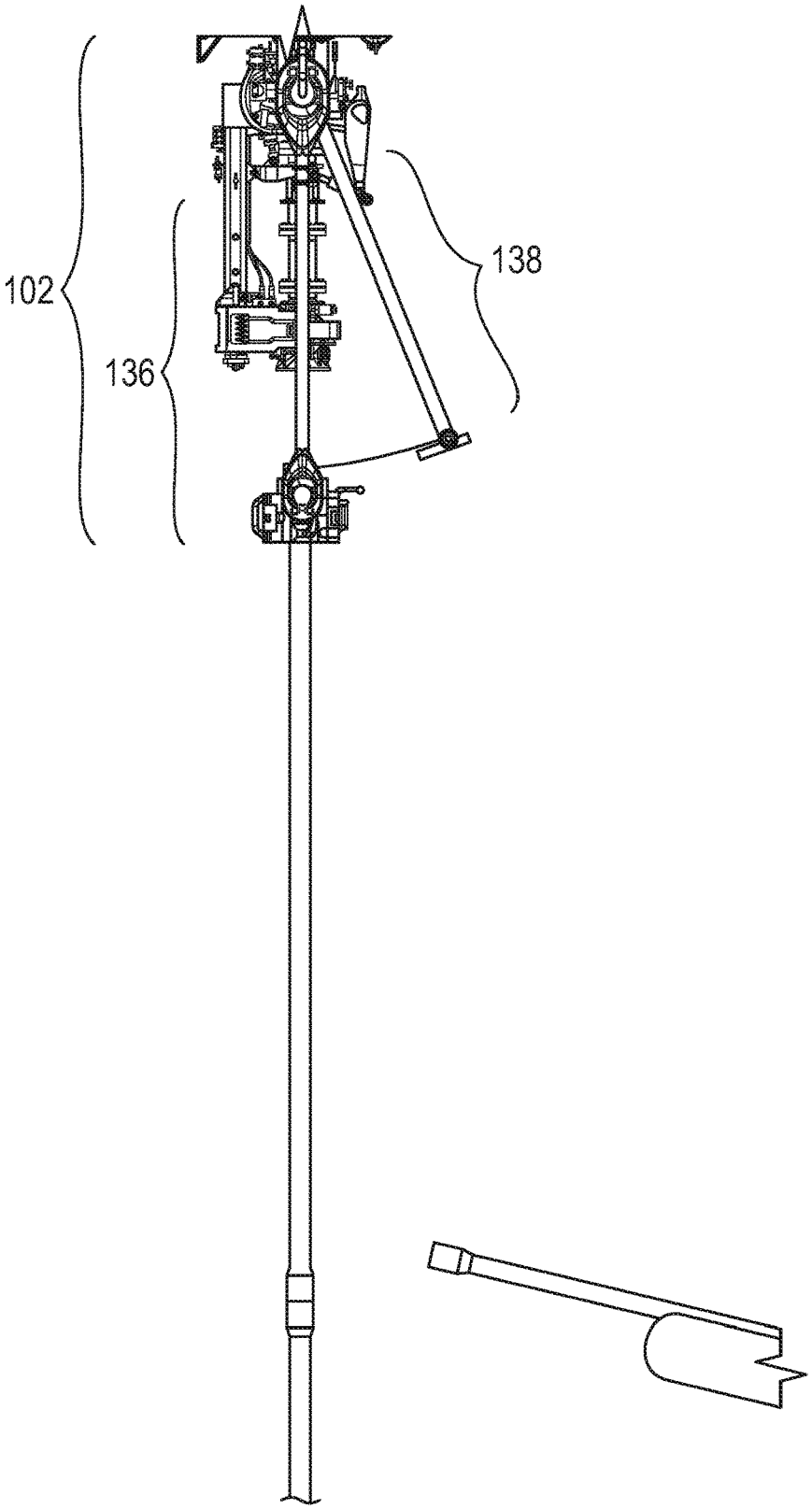
FIG. 9 is a side view of the dual activity top drive in place on a drill string and having an auxiliary elevator poised to pick a new length of drill pipe, according to one or more embodiments.
Figure 10:
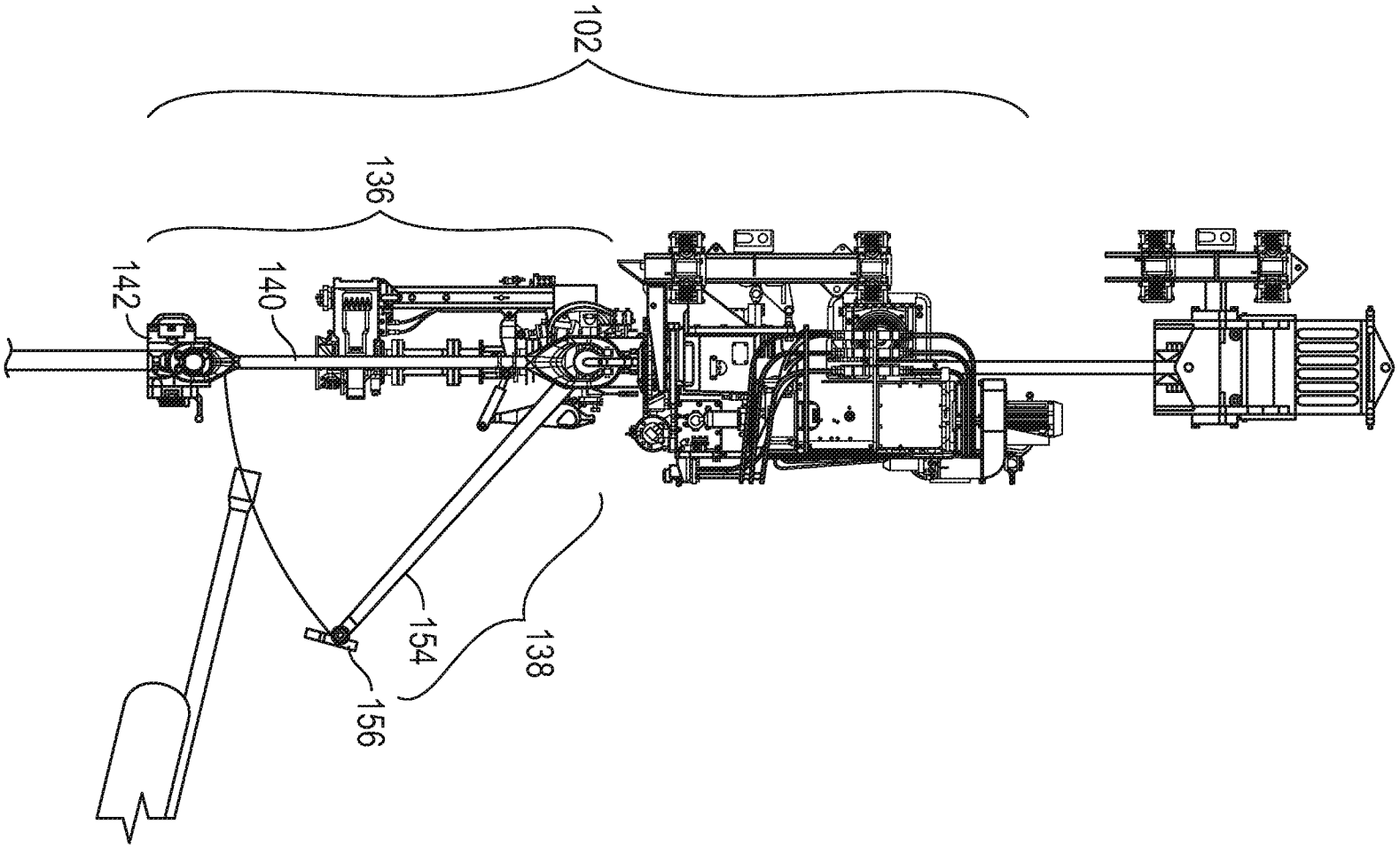
FIG. 10 is a side view of the dual activity top drive approaching the new length of drill pipe while still holding the drill string, according to one or more embodiments.
Figure 11:
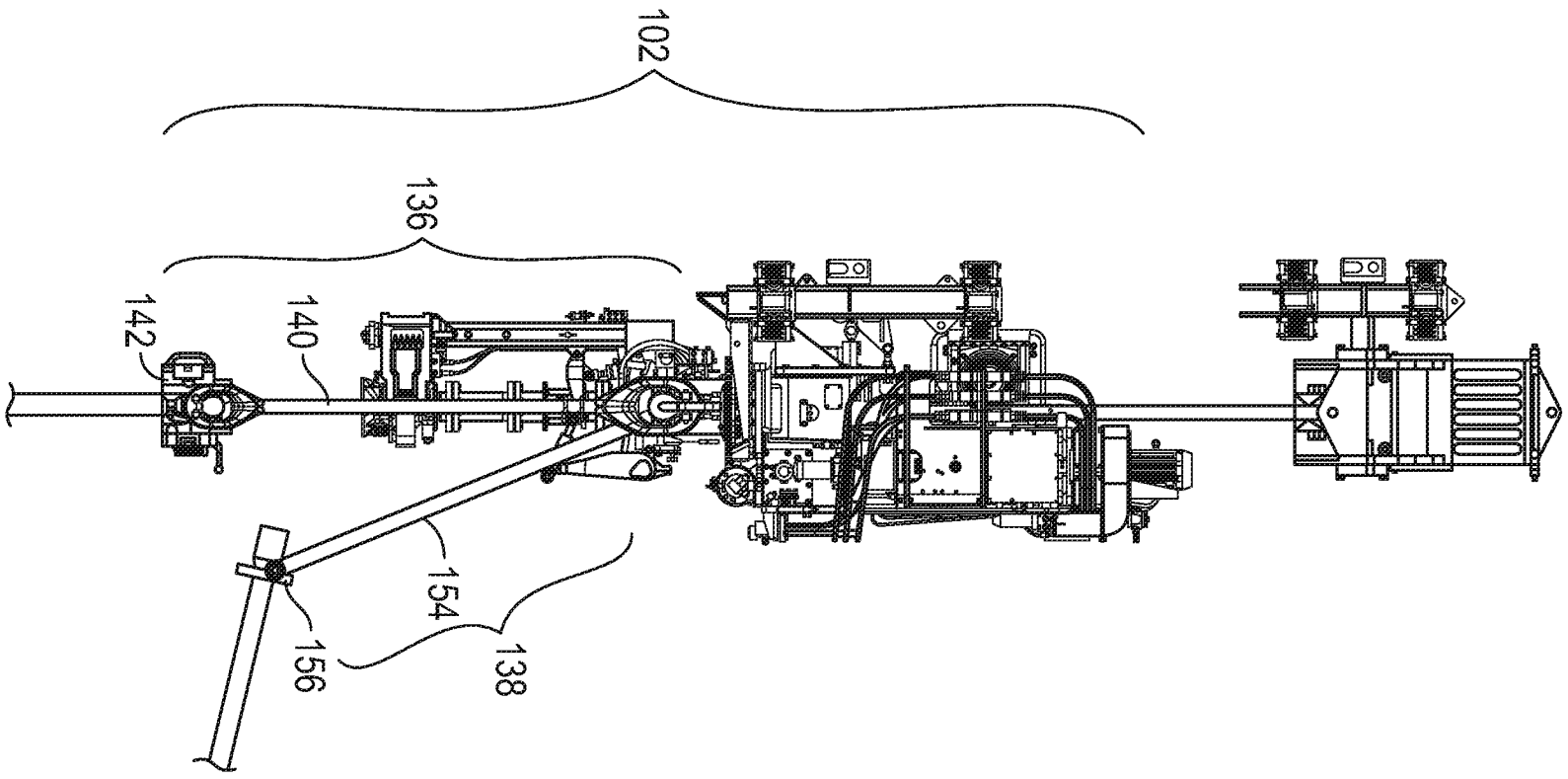
FIG. 11 is a side view of the dual activity top drive engaging the new length of drill pipe while still holding the drill string, according to one or more embodiments.
Figure 12:
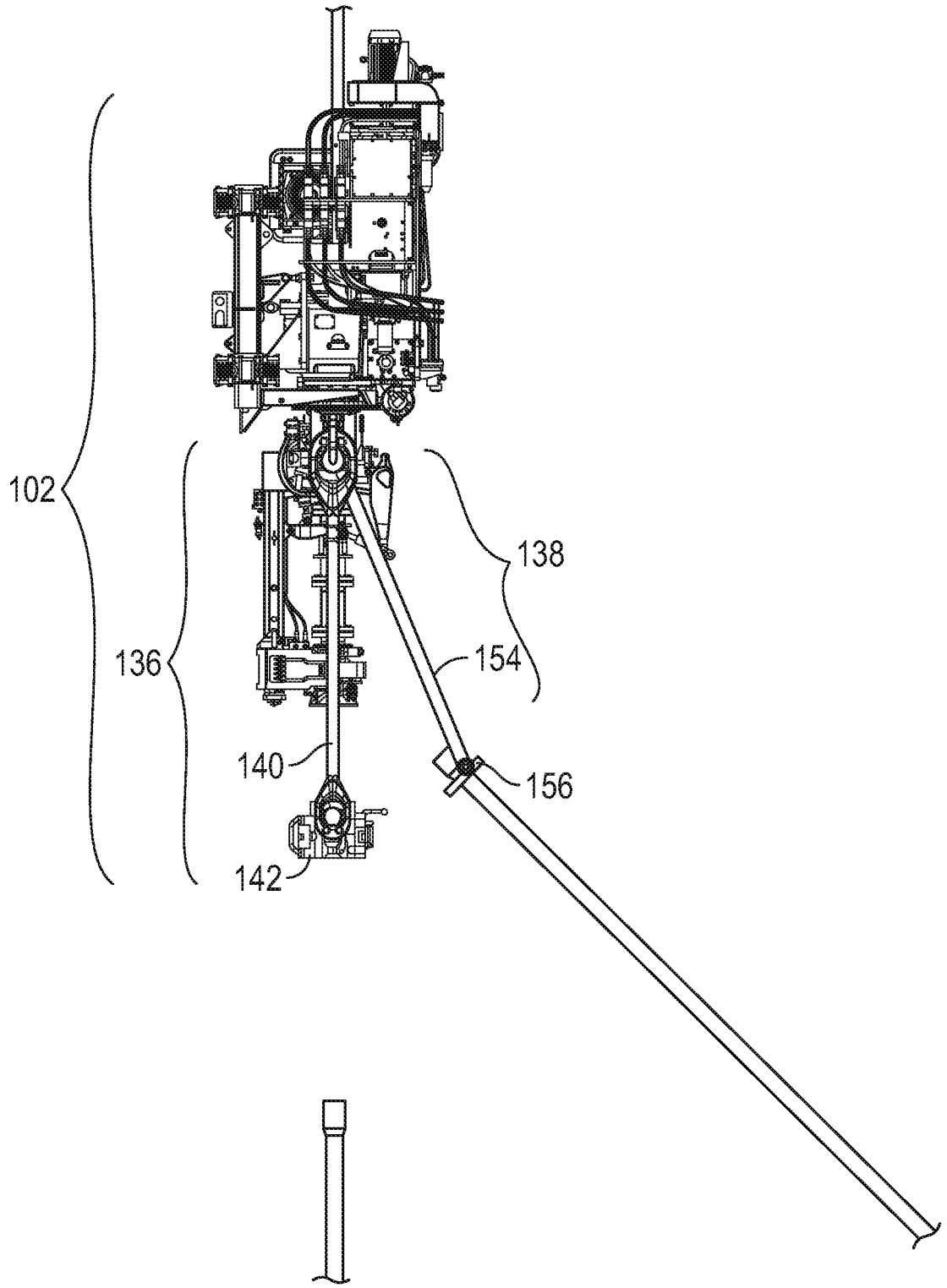
FIG. 12 is a side view of the dual activity top drive lifting the new length of drill pipe, according to one or more embodiments.
Figure 13:
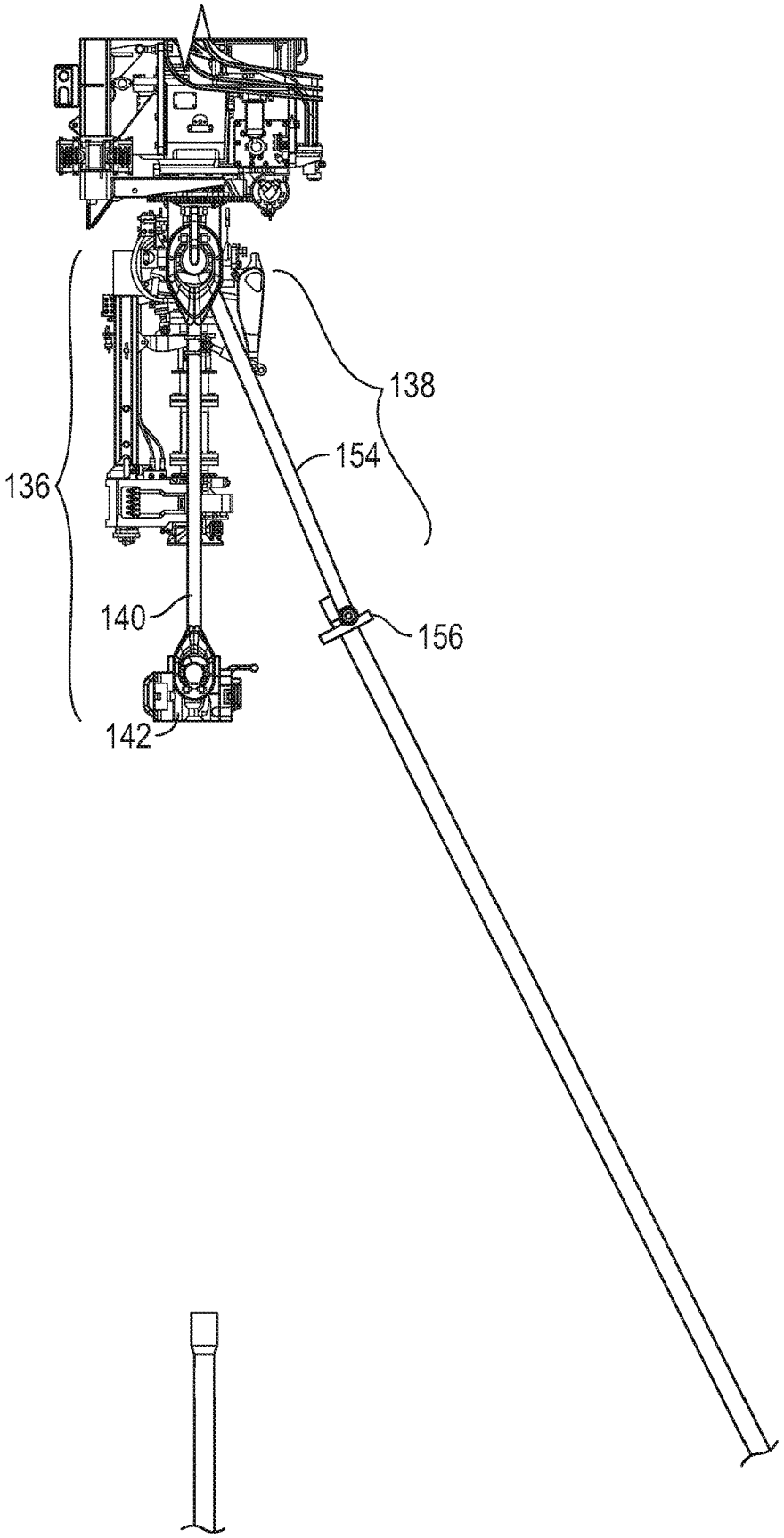
FIG. 13 is a side view of the dual activity top drive lifting the new length of drill pipe further, according to one or more embodiments.
Figure 14:
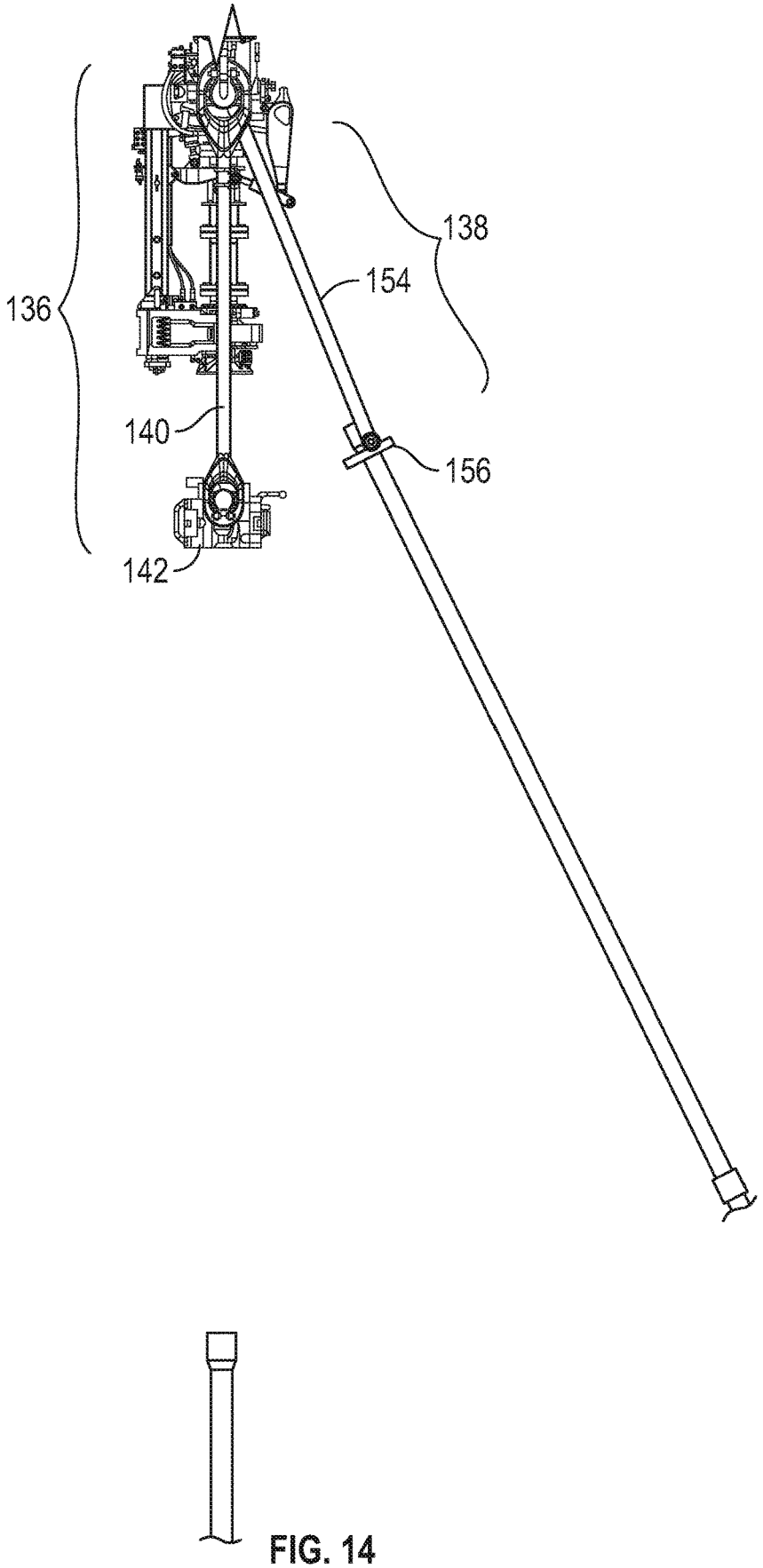
FIG. 14 is a side view of the dual activity top drive lifting the new length of drill pipe further to clear the v-door, according to one or more embodiments.
Figure 15:
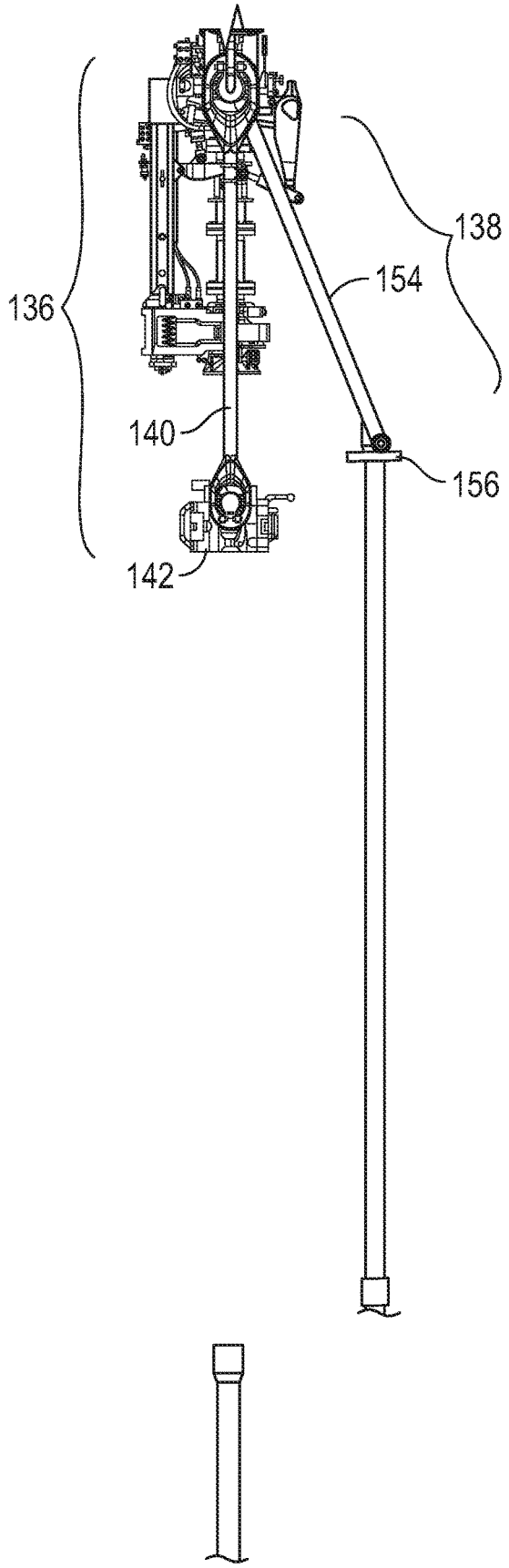
FIG. 15 is a side view of the dual activity top drive having lifted the new length of drill pipe to a substantially vertical position, according to one or more embodiments.
Figure 16:
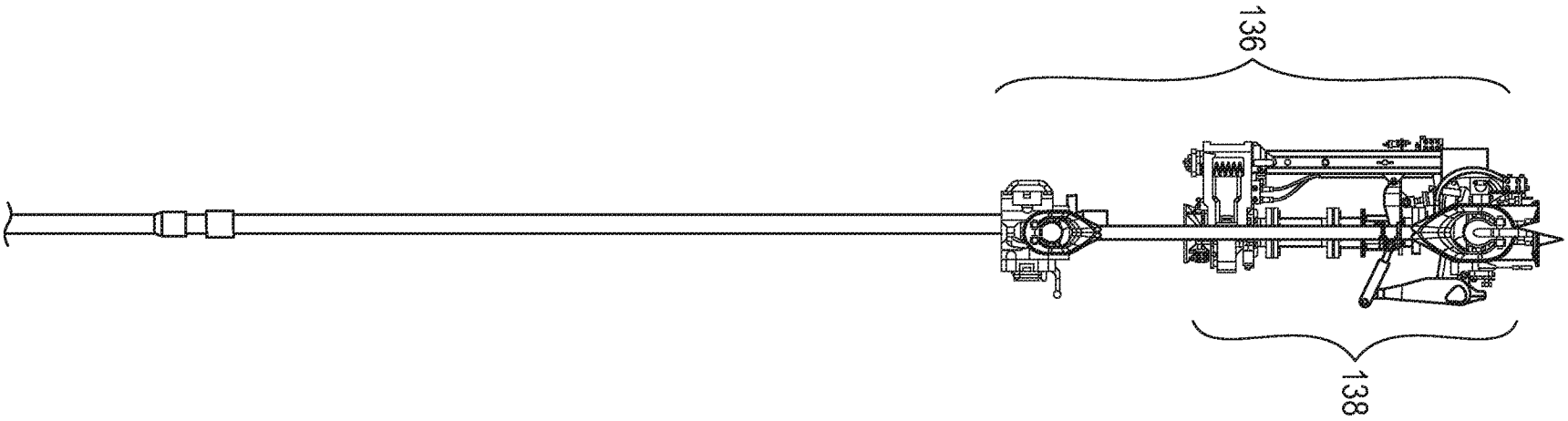
FIG. 16 is a side view of the dual activity top drive having swung the new length of drill pipe to well center and poised to stab the new length of drill pipe into the drill string.
Figure 17A:
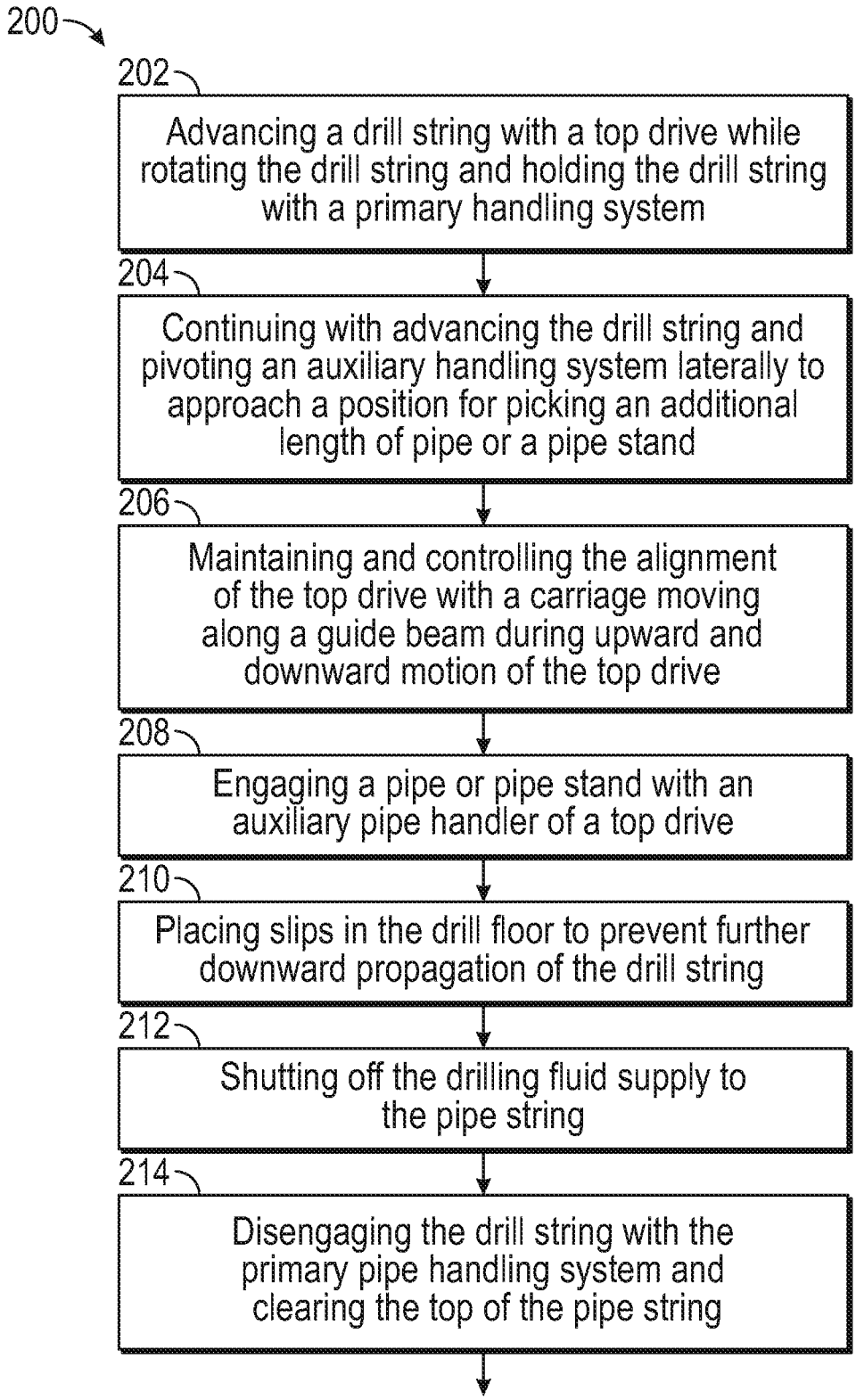
FIG. 17A is a portion of a flow chart depicting operations relating to tripping drill pipe, according to one or more embodiments.
Figure 17B:
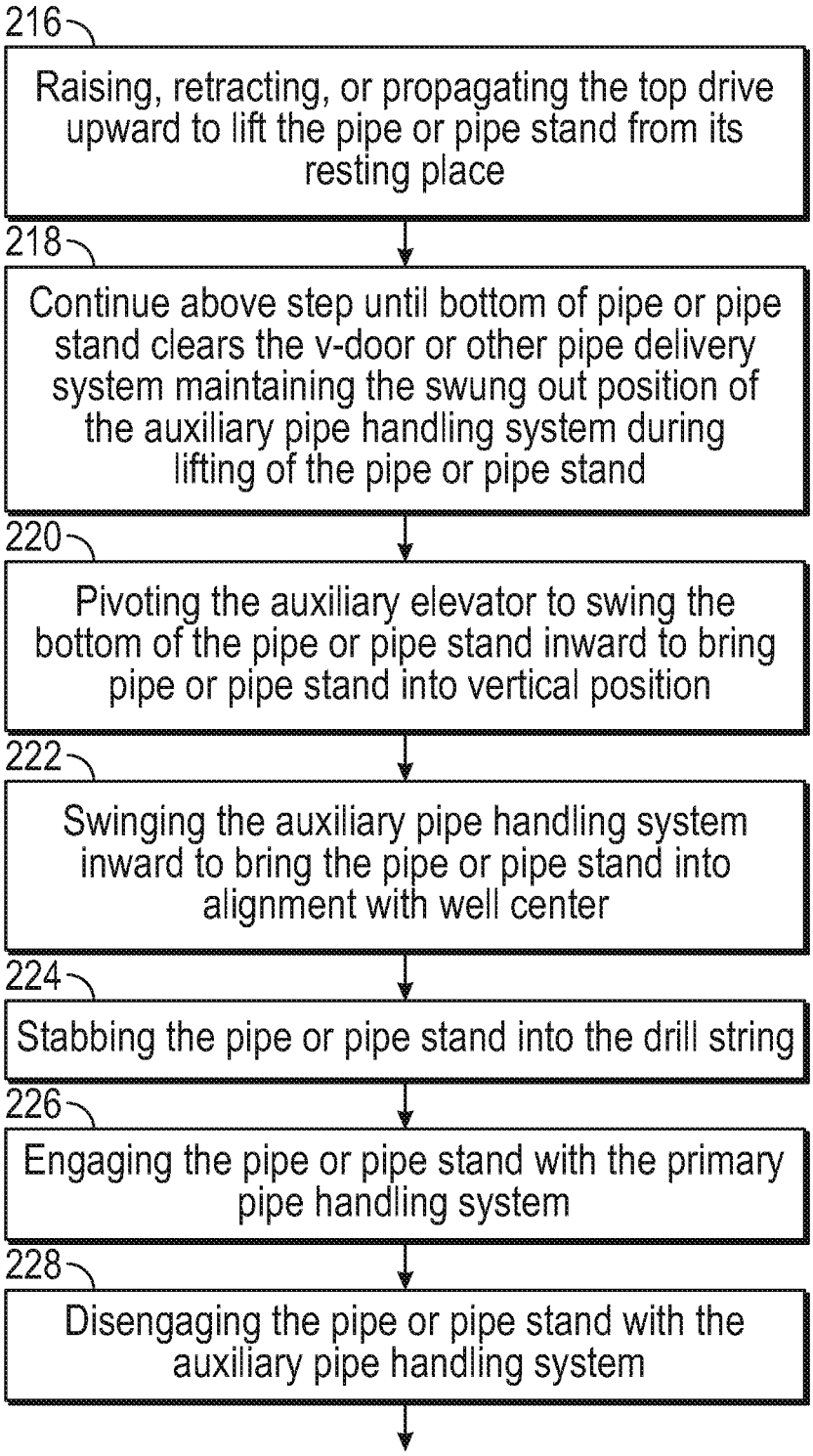
FIG. 17B is a portion of a flow chart depicting operations relating to tripping drill pipe, according to one or more embodiments.
Figure 17C:
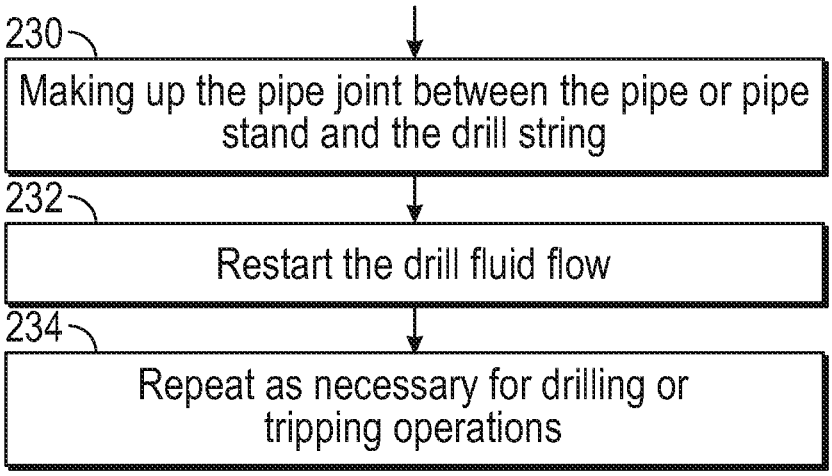
FIG. 17C is a portion of a flow chart depicting operations relating to tripping drill pipe, according to one or more embodiments.

Referring now to the various stages of a process shown in FIGS. 8-16 and the flow chart of FIGS. 17A-17C, a method of operation 200 may be described using the dual activity top drive described herein. That is, the method may be applicable to drilling operations or to tripping drill pipe into a well. The method may also be performed substantially in reverse for tripping drill pipe out of a well. As shown in FIG. 8, a dual activity top drive may be in position and in secured arrangement at the top of a drill string. That is, the pipe engagement portion may be frilly engaged with the top of the drill string and may be advancing the drill string while rotating the drill string. (202) The primary handling system may also be engaged with the top of the drill string. In FIG. 9, the top drive may be propagating closer to the drill floor and the auxiliary handling system may begin pivoting laterally to approach a position for picking an additional length of pipe or a pipe stand. (204) The pivoting of the auxiliary system may be performed by the auxiliary bail positioning system. That is, the hydraulic or other mechanism may swing the bracket and legs causing pivoting of the links/bails and beginning to swing the elevator toward a position above the additional pipe. Also, as the top drive moves downward toward the drill floor, the carriage of the top drive may move along the guide beam to maintain and control the alignment of the top drive with well center. (206) Referring now to FIG. 10, the top drive may be at or near its lowest position relative to the drill floor and may be poised to release the drill string. As also shown, the auxiliary pipe handling system may be arranged above the additional pipe to be added to the drill string. FIG. 11 shows the auxiliary elevator positioned on the top end of the additional pipe to be added to the drill string. The auxiliary elevator may be secured to the top of the pipe to be added with hydraulic pressure or by otherwise squeezing the jaws of the elevator closed around the pipe. (208) While not shown, slips or wedges may be placed in the drill floor to prevent further downward propagation of the drill string and allowing the primary pipe handling system to disengage the drill string without fear that the drill string will be dropped into the well. (210) Disengaging the drill string with the primary pipe handling system may include opening the primary elevator and clearing the top of the pipe string by adjusting the bails/links slightly to clear the belled top of the pipe. (214) In addition, if drilling operations were being performed, the drilling fluid may be shut off for the time being such that the top drive may be disconnected without ejecting drill fluid. (212) With the additional pipe being secured by the auxiliary pipe handling system, the drill string secured at the drill floor, and the primary pipe handling system disengaged and cleared from the drill string, the top drive may begin to propagate upward as shown in FIG. 12. (216) Since the additional pipe is being managed by the auxiliary system, this upward propagation or retraction of the top drive may occur immediately. As the top drive retracts, the carriage on the top drive may be guided by the guide beam to maintain the top drive arranged substantially over well center. As the top drive propagates upward the bottom of the additional pipe or pipe string may slide up the ramp/conveyor toward the v-door on the drill floor until approaching the top of the v-door as shown in FIG. 13 and clearing the top of the v-door as shown in FIG. 14. (218) As shown, the auxiliary pipe handling system may maintain its swung out position to minimize or reduce pipe swing. That is, as the bottom of the pipe or stand clears the v-door, it may swing inward causing the elevator to pivot relative to the link/bails and allowing the pipe to hang substantially vertically as shown in FIG. 15. (220) In one or more embodiments, a tailing system may be provided to control the inward swing of the bottom of the pipe. Referring to FIG. 16, the auxiliary pipe handling system may swing inward aligning the additional pipe and/or pipe stand with well center and allowing the additional pipe or pipe stand to be stabbed into the top of the drill string. (222/224) The primary pipe handling system may receive the additional pipe and may engage the additional pipe and the auxiliary pipe handling system may disengage the additional pipe, thus, preparing itself for the next pipe addition. (226/228) The joint may be made up by threadably securing the additional pipe to the top of the drill string. (230) If drilling operations are being conducted, the drill fluid may be pumped into the newly added section of drill pipe and drilling operations may commence. (232) The process may continue in repeating fashion. (234)

Various embodiments of the present disclosure may be described herein with reference to flowchart illustrations and/or block diagrams of methods, apparatus (systems), and computer program products. Although a flowchart or block diagram may illustrate a method as comprising sequential steps or a process as having a particular order of operations, many of the steps or operations in the flowchart(s) or block diagram(s) illustrated herein can be performed in parallel or concurrently, and the flowchart(s) or block diagram(s) should be read in the context of the various embodiments of the present disclosure. In addition, the order of the method steps or process operations illustrated in a flowchart or block diagram may be rearranged for some embodiments. Similarly, a method or process illustrated in a flow chart or block diagram could have additional steps or operations not included therein or fewer steps or operations than those shown. Moreover, a method step may correspond to a method, a function, a procedure, a subroutine, a subprogram, etc.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an element may still actually contain such element as long as there is generally no significant effect thereof.

To aid the Patent Office and any readers of any patent issued on this application in interpreting the claims appended hereto, applicants wish to note that they do not intend any of the appended claims or claim elements to invoke 35 U.S.C. § 112(f) unless the words "means for" or "step for" are explicitly used in the particular claim.

Additionally, as used herein, the phrase "at least one of [X] and [Y]," where X and Y are different components that may be included in an embodiment of the present disclosure, means that the embodiment could include component X without component Y, the embodiment could include the component Y without component X, or the embodiment could include both components X and Y. Similarly, when used with respect to three or more components, such as "at least one of [X], [Y], and [Z]," the phrase means that the embodiment could include any one of the three or more components, any combination or sub-combination of any of the components, or all of the components.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

What is claimed is:

1. A dual activity top drive, comprising:

a mechanized system configured for suspension from a traveling block of a drill rig and for engaging and rotating a drill string from the top of the drill string;

a primary pipe handling system suspended from the mechanized system, configured for handling a pipe string, comprising a first pair of bails pivotally secured to the mechanized system, and including a first pipe elevator configured for laterally receiving the pipe string through a lateral opening in the first pipe elevator and securing the laterally received pipe string; and an auxiliary pipe handling system suspended from the mechanized system, configured for handling a segment of pipe to be added or removed from the pipe string, comprising a second pair of bails pivotally secured to the mechanized system, and including a second pipe elevator for securing a segment of pipe to be added or removed from the pipe string, wherein the auxiliary pipe handling system is configured so that a first center axis of the first pipe elevator can be aligned with a second center axis of the second pipe elevator over the top of the drill string.

2. The dual activity top drive of claim 1, wherein the second pair of bails are arranged on an inboard side of the first pair of bails.

3. The dual activity top drive of claim 2, wherein the second elevator is arranged above the first elevator.

4. The dual activity top drive of claim 1, wherein the primary pipe handling system comprises a first bail position control configured for controlling pivoting motion of the first pair of hails.

5. The dual activity top drive of claim 4, wherein the auxiliary pipe handling system comprises a second bail position control configured for controlling pivoting motion of the second pair of bails.

6. The dual activity top drive of claim 1, wherein the auxiliary pipe handling system is nested within the primary pipe handling system.

7. The dual activity top drive of claim 1, wherein the auxiliary pipe handling system is arranged around an outside of the primary pipe handling system.

8. A method of tripping drill pipe, comprising:

using a top drive on a drill rig, lowering a drill string into a well bore while securing the drill string with a primary pipe handling system having an elevator;

while lowering the drill string, pivoting an auxiliary pipe handling system into position for retrieving an additional pipe to be added to the drill string, the pivoting comprising pivoting the auxiliary pipe handling system outward away from well center and to a position generally above a horizontal or near horizontal presentation of a drill pipe;

securing the additional pipe with the auxiliary pipe handling system;

retracting the top drive and allowing the additional pipe to arrive at a vertical position offset from well center; and moving the additional pipe to well center and laterally receiving the pipe through a lateral opening in the elevator and securing the laterally received pipe with the elevator.

9. The method of claim 8, wherein the drill rig comprises a drill floor and the method further comprises placing slips in the drill floor to secure the drill string.

10. The method of claim 8, further comprising releasing the drill string with the primary handling system to clear the top of the pipe string and retracting the top drive.

11. The method of claim 10, wherein retracting the top drive is performed immediately upon clearing the top of the pipe string.

12. The method of claim 8, further comprising stabbing the additional pipe into the drill string.

13. A drill rig comprising:

a top drive suspended from a travelling block of the drill rig, the top drive comprising:

a mechanized system configured for engaging and rotating a drill string from the top of the drill string;

a primary pipe handling system suspended from the mechanized system, configured for handling a pipe string, comprising a first pair of bails pivotally secured to the mechanized system, and including a first pipe elevator configured for laterally receiving the pipe string through a lateral opening in the first pipe elevator and securing the laterally received pipe string; and an auxiliary pipe handling system suspended from the mechanized system, configured for handling a segment of pipe to be added or removed from the pipe string, comprising a second pair of bails pivotally secured to the mechanized system, and including a second pipe elevator for securing a segment of pipe to be added or removed from the pipe string, wherein the auxiliary pipe handling system is configured so that a first center axis of the first pipe elevator can be aligned with a second center axis of the second pipe elevator over the top of the drill string.

14. The drill rig of claim 13, wherein the auxiliary pipe handling system is nested within the primary pipe handling system.

* * * * *